US009170506B2

(12) United States Patent
Tanaka et al.

(10) Patent No.: US 9,170,506 B2
(45) Date of Patent: Oct. 27, 2015

(54) ELECTROPHOTOGRAPHIC PHOTOSENSITIVE MEMBER, PROCESS CARTRIDGE AND ELECTROPHOTOGRAPHIC APPARATUS

(71) Applicant: CANON KABUSHIKI KAISHA, Tokyo (JP)

(72) Inventors: Daisuke Tanaka, Yokohama (JP); Kazumichi Sugiyama, Numazu (JP); Tsutomu Nishida, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/146,457

(22) Filed: Jan. 2, 2014

(65) Prior Publication Data

US 2014/0205940 A1 Jul. 24, 2014

(30) Foreign Application Priority Data

Jan. 18, 2013 (JP) ..... 2013-007483

(51) Int. Cl.

| | |
|---|---|
| ***G03G 5/00*** | (2006.01) |
| ***G03G 5/043*** | (2006.01) |
| ***G03G 5/147*** | (2006.01) |
| ***G03G 5/05*** | (2006.01) |

(52) U.S. Cl.

CPC ..... *G03G 5/043* (2013.01); *G03G 5/0503* (2013.01); *G03G 5/0578* (2013.01); *G03G 5/0589* (2013.01); *G03G 5/14708* (2013.01); *G03G 5/14752* (2013.01); *G03G 5/14756* (2013.01); *G03G 5/14773* (2013.01); *G03G 5/14786* (2013.01)

(58) Field of Classification Search

CPC ..... G03G 5/14708; G03G 5/14752; G03G 5/14756; G03G 5/14786

USPC ..... 430/66

See application file for complete search history.

(56) References Cited

U.S. PATENT DOCUMENTS

| | | | | |
|---|---|---|---|---|
| 4,716,091 | A | 12/1987 | Yoshihara et al. | |
| 6,165,662 | A | 12/2000 | Kato et al. | |
| 2005/0233235 | A1* | 10/2005 | Qi et al. | 430/66 |
| 2010/0209136 | A1 | 8/2010 | Mizushima et al. | |
| 2014/0205941 | A1 | 7/2014 | Nishi et al. | |
| 2014/0205946 | A1 | 7/2014 | Sugiyama et al. | |

FOREIGN PATENT DOCUMENTS

| | | | |
|---|---|---|---|
| JP | 58-167606 | A | 10/1983 |
| JP | 62-75462 | A | 4/1987 |
| JP | 7-13368 | A | 1/1995 |
| JP | 3278016 | B2 | 4/2002 |

(Continued)

OTHER PUBLICATIONS

European Search Report dated May 19, 2014 in European Application No. 14000175.1.

(Continued)

*Primary Examiner* — Mark A Chapman

(74) *Attorney, Agent, or Firm* — Fitzpatrick, Cella, Harper and Scinto

(57) ABSTRACT

In an electrophotographic photosensitive member including a support, and a photosensitive layer formed on the support, a surface layer of the electrophotographic photosensitive member includes specific resin (α), resin (β) and compound (γ).

10 Claims, 1 Drawing Sheet

(56) References Cited

FOREIGN PATENT DOCUMENTS

| | | | |
|---|---|---|---|
| JP | 3781268 | B2 | 5/2006 |
| JP | 2007-47655 | A | 2/2007 |
| JP | 2007-72277 | A | 3/2007 |
| JP | 2007-79555 | A | 3/2007 |
| JP | 2007-199688 | A | 8/2007 |
| JP | 2008-299119 | A | 12/2008 |

OTHER PUBLICATIONS

Matsuda et al., U.S. Appl. No. 14/284,945, filed May 22, 2014.

* cited by examiner

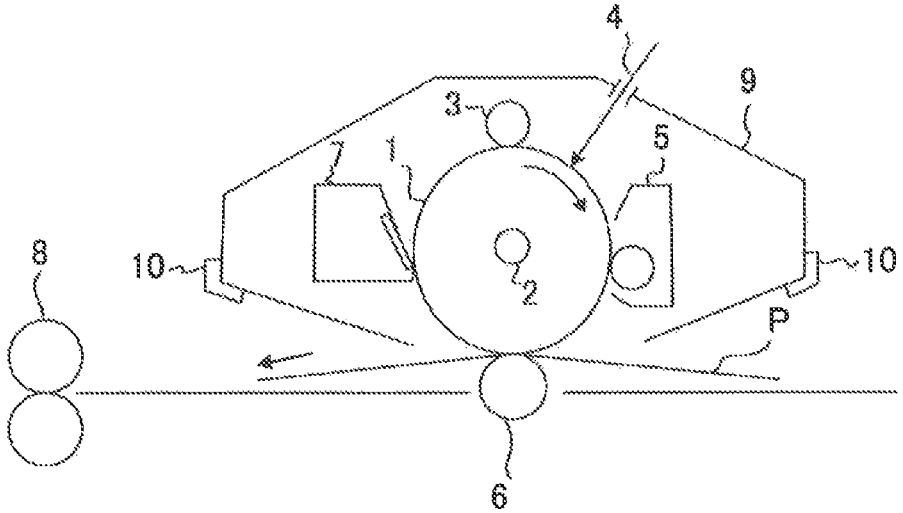
4
9
3
5
1
7
8
10
10
2
P
6

ELECTROPHOTOGRAPHIC PHOTOSENSITIVE MEMBER, PROCESS CARTRIDGE AND ELECTROPHOTOGRAPHIC APPARATUS

BACKGROUND OF THE INVENTION

1. Field of the Invention

The present invention relates to an electrophotographic photosensitive member, a process cartridge and an electrophotographic apparatus.

2. Description of the Related Art

As an electrophotographic photosensitive member to be mounted on an electrophotographic apparatus, an electrophotographic photosensitive member containing an organic photoconductive substance (charge generation substance) is commonly used. As an electrophotographic apparatus repeatedly forms an image, electric and mechanical external forces such as charging, exposing, developing, transferring and cleaning external forces are directly applied to the surface of an electrophotographic photosensitive member, and thus there is a demand for durability to such external forces. Furthermore, there is also a demand for reducing the frictional force to a contacting member (cleaning blade or the like) (lubricating properties and slipping properties) on the surface of an electrophotographic photosensitive member.

In order to solve the problem of lubricating properties, a method of adding a silicone oil such as polydimethylsiloxane to the surface layer of an electrophotographic photosensitive member has been proposed in Japanese Patent Application Laid-Open No. H07-13368. In addition, a method of using a polycarbonate resin having a siloxane structure at the end for the surface layer of an electrophotographic photosensitive member has been proposed in Japanese Patent No. 3278016. In addition, a method of using a polyester resin having a siloxane structure at the end for the surface layer has been proposed in Japanese Patent No. 3781268.

However, it has been found that if the silicone oil is contained in the surface layer of the electrophotographic photosensitive member as in Japanese Patent Application Laid-Open No. H07-13368, there may be a tendency that the surface layer is whitened to result in the reduction in sensitivity to thereby lower image density.

In addition, it has been found that if the polycarbonate resin and the polyester resin each having a siloxane structure at the end are used as in Japanese Patent No. 3278016 and Japanese Patent No. 3781268, the variation in bright portion potential due to the repeating use of the electrophotographic photosensitive member may be large as compared with the case of using a resin not having a siloxane structure.

SUMMARY OF THE INVENTION

The present invention is directed to providing an electrophotographic photosensitive member comprising a surface layer containing a resin having a siloxane structure at the end, that allows the reduction in initial frictional force (initial friction coefficient) and the suppression of the variation in bright portion potential due to the repeating use. Further, the present invention is directed to providing a process cartridge and an electrophotographic apparatus including such an electrophotographic photosensitive member.

The above objects are achieved according to the following present invention.

According to one aspect of the present invention, there is provided an electrophotographic photosensitive member comprising a support; a photosensitive layer formed on the support; wherein a surface layer of the electrophotographic photosensitive member includes:

(α) at least one resin selected from the group consisting of a polycarbonate resin not having a siloxane structure at the end and a polyester resin not having a siloxane structure at the end, (β) at least one resin selected from the group consisting of a polycarbonate resin having a siloxane structure at the end, a polyester resin having a siloxane structure at the end, and an acrylic resin having a siloxane structure at the end, and (γ) at least one compound selected from the group consisting of propylene carbonate, γ-butyrolactone, δ-valerolactone and ε-caprolactone.

According to another aspect of the present invention, there is provided a process cartridge detachably attachable to a main body of an electrophotographic apparatus, wherein the process cartridge integrally supports the electrophotographic photosensitive member, and at least one unit selected from the group consisting of a charging unit, a developing unit, a transferring unit, and a cleaning unit.

According to further aspect of the present invention, there is provided an electrophotographic apparatus including the electrophotographic photosensitive member, a charging unit, an exposure unit, a developing unit, and a transferring unit.

According to the present invention, an electrophotographic photosensitive member including a surface layer containing a resin having a siloxane structure at the end, which simultaneously better satisfies the reduction in initial friction coefficient and the suppression of the variation in bright portion potential due to the repeating use, and a process cartridge and an electrophotographic apparatus including the electrophotographic photosensitive member can be provided.

Further features of the present invention will become apparent from the following description of exemplary embodiments with reference to the attached drawing.

BRIEF DESCRIPTION OF THE DRAWING

FIGURE is a view illustrating one example of a schematic structure of an electrophotographic apparatus provided with a process cartridge including an electrophotographic photosensitive member according to the present invention.

DESCRIPTION OF THE EMBODIMENTS

Preferred embodiments of the present invention will now be described in detail in accordance with the accompanying drawings.

The electrophotographic photosensitive member of the present invention is as described above, an electrophotographic photosensitive member including a support and a photosensitive layer formed on the support, wherein the electrophotographic photosensitive member includes a surface layer containing as constituent elements, the above (α) (constituent element (α)), the above (β) (constituent element (β)) and the above (γ) (constituent element (γ)). Hereinafter, the above (α) is also referred to as "resin α", the above (β) is also referred to as "resin β", and the above (γ) is also referred to as "compound γ".

The present inventors presume that the reason why the surface layer includes the compound γ of the present invention to thereby exhibit the effect of simultaneously better satisfying the reduction in initial friction coefficient and the suppression of the variation in bright portion potential due to the repeating use in the electrophotographic photosensitive member is as follows.

It is presumed that the resin β in the surface layer serves as a barrier against the charge-passing from the lower layer of the surface layer (e.g., charge generation layer) to the surface layer (e.g., charge transport layer), thereby resulting in causing the increase in bright portion potential. It is considered that the compound γ functions to promote the charge-passing from the lower layer of the surface layer to the surface layer.

<Regarding Resin α>

The resin α represents at least one resin of a polycarbonate resin not having a siloxane structure at the end and a polyester resin not having a siloxane structure at the end.

In the present invention, the polycarbonate resin not having a siloxane structure at the end can be a polycarbonate resin A having a structural unit represented by the following formula (A). The polyester resin not having a siloxane structure at the end can be a polyester resin B having a structural unit represented by the following formula (B).

(A)

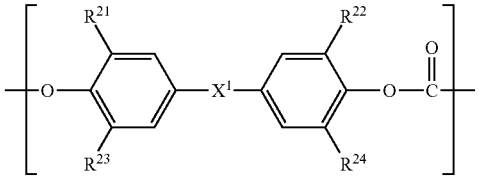

In the formula (A), $R^{21}$ to $R^{24}$ each independently represents a hydrogen atom or a methyl group. $X^1$ represents a single bond, a cyclohexylidene group, or a divalent group having a structure represented by the following formula (C).

(B)

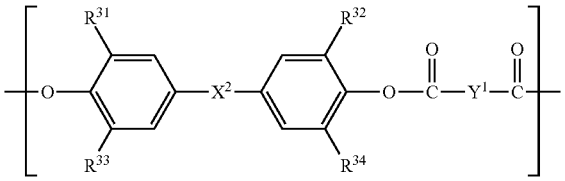

In the formula (B), $R^{31}$ to $R^{34}$ each independently represents a hydrogen atom or a methyl group. $X^2$ represents a single bond, a cyclohexylidene group, or a divalent group having a structure represented by the following formula (C). $Y^1$ represents a m-phenylene group, a p-phenylene group, or a divalent group in which two p-phenylene groups are bound to each other via an oxygen atom.

(C)

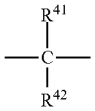

In the formula (C), $R^{41}$ and $R^{42}$ each independently represents a hydrogen atom, a methyl group or a phenyl group.

Specific examples of the structural unit of the polycarbonate resin A represented by the formula (A) are illustrated below.

(A-1)

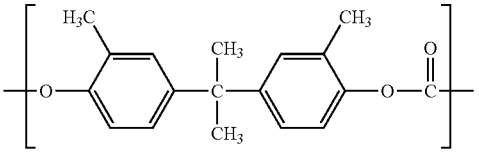

(A-2)

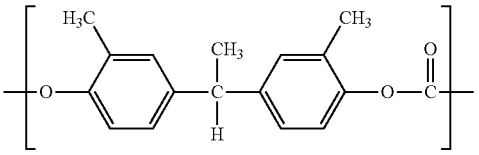

(A-3)

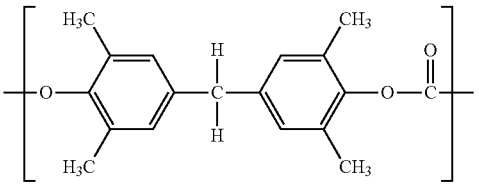

(A-4)

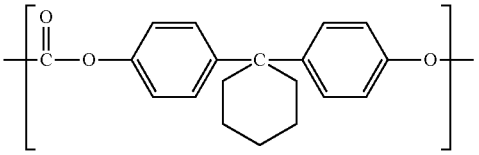

(A-5)

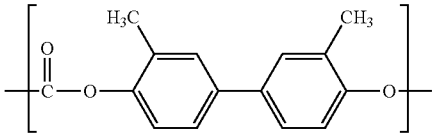

(A-6)

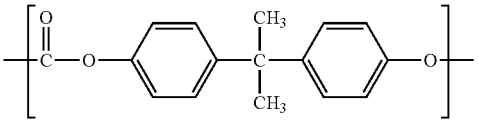

(A-7)

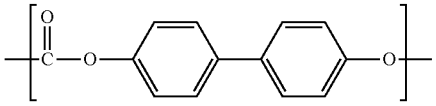

(A-8)

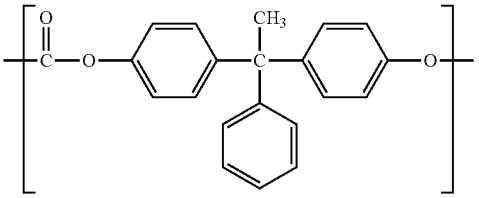

The polycarbonate resin A may be a polymer of one of the structural units of the above (A-1) to (A-8), or may be a copolymer of two or more thereof. Among them, the structural units represented by the formulas (A-1), (A-2) and (A-4) are preferable.

Specific examples of the structural unit of the polyester resin B represented by the formula (B) are illustrated below.

[Formula 5]

(B-1)

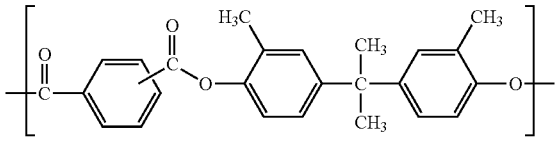

(B-2)

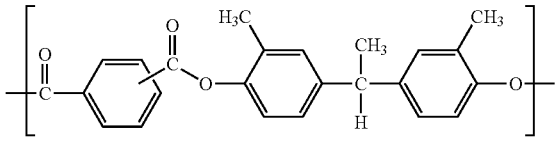

(B-3)

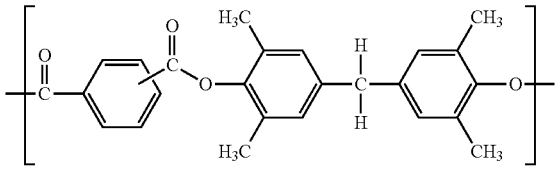

(B-4)

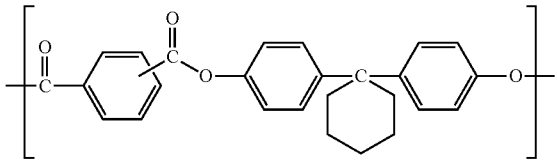

(B-5)

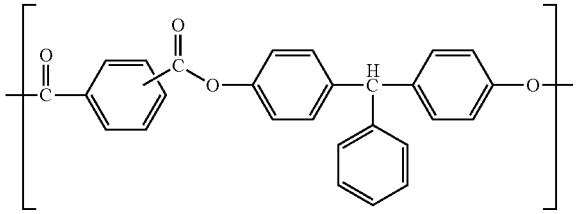

(B-6)

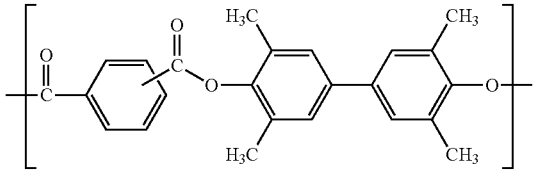

(B-7)

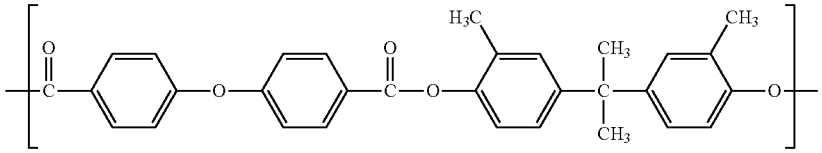

(B-8)

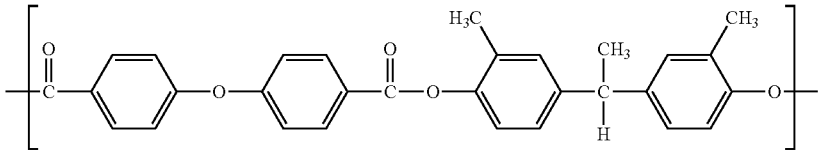

(B-9)

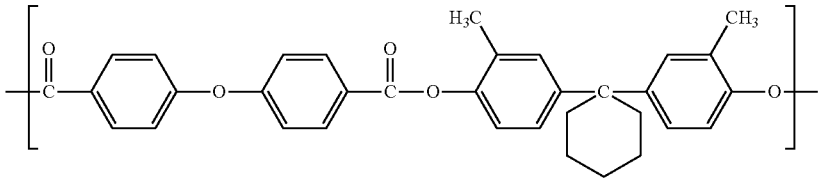

The polyester resin B may be a polymer of one of the structural units of the above (B-1) to (B-9), or may be a copolymer of two or more thereof. Among them, the structural unit represented by the formulas (B-1), (B-2), (B-3), (B-6), (B-7) and (B-8) are preferable.

The polycarbonate resin A and the polyester resin B can be synthesized by, for example, a conventional phosgene method, and can also be synthesized by an interesterification method.

The copolymerization forms of the polycarbonate resin A and the polyester resin B may be any of block copolymerization, random copolymerization, alternating copolymerization and the like.

The polycarbonate resin A and the polyester resin B can be synthesized by any known method, and can be synthesized by the method described in, for example, Japanese Patent Application Laid-Open No. 2007-047655 or Japanese Patent Application Laid-Open No. 2007-072277.

The weight average molecular weight of each of the polycarbonate resin A and the polyester resin B is preferably not less than 20,000 and not more than 300,000, and more preferably not less than 50,000 and not more than 200,000. In the present invention, the weight average molecular weight of the resin means a weight average molecular weight in terms of polystyrene measured by the method described in Japanese Patent Application Laid-Open No. 2007-79555 according to the common method.

The polycarbonate resin A and the polyester resin B as the resin α may be a copolymer having a structural unit containing a siloxane structure besides the structural unit represented by the formula (A) or the formula (B). Specific examples include structural units containing a siloxane structure represented by the following formulas (H-1) and (H-2). The polycarbonate resin A and the polyester resin B may further have a structural unit represented by the following formula (H-3).

(H-1)

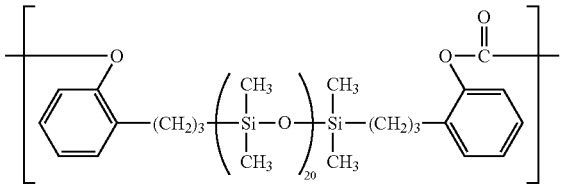

(H-2)

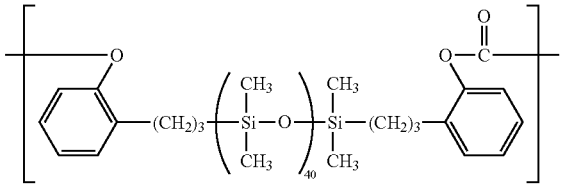

(H-3)

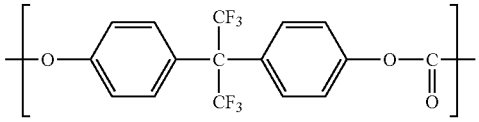

Specific resins to be used as the resin α are shown below.

TABLE 1

| Component [α] (Polycarbonate Resin A · Polyester Resin B) | Repeating structural unit | Ratio of repeating structural units (mass ratio) | Weight average molecular weight (Mw) |
|---|---|---|---|
| Resin A(1) | (A-4) | — | 55,000 |
| Resin A(2) | (A-4) | — | 14,000 |
| Resin A(3) | (A-4) | — | 110,000 |
| Resin A(4) | (A-6) | — | 55,000 |
| Resin A(5) | (A-1) | — | 54,000 |
| Resin A(6) | (A-6)/(A-1) | 6.5/3.5 | 55,000 |
| Resin A(7) | (A-4)/(H-1) | 9/1 | 55,000 |
| Resin A(8) | (A-4)/(H-1) | 9/1 | 110,000 |
| Resin A(9) | (A-4)/(H-1)/(H-3) | 6/1.5/2.5 | 60,000 |
| Resin B(1) | (B-1) | — | 120,000 |
| Resin B(2) | (B-1)/(B-6) | 7/3 | 120,000 |
| Resin B(3) | (B-8) | — | 100,000 |

In Table 1, with respect to the resin B(1) and the structural units represented by the formulas (B-1) and (B-6) in the resin B(2), the molar ratio of a terephthalic acid structure to an isophthalic acid structure (terephthalic acid backbone:isophthalic acid backbone) is 5/5.

<Regarding Resin β>

The resin β has at least one resin selected from the group consisting of a polycarbonate resin having a siloxane structure at the end, a polyester resin having a siloxane structure at the end, and an acrylic resin having a siloxane structure at the end.

In the present invention, the polycarbonate resin, the polyester resin and the acrylic resin each having a siloxane structure at the end are used to thereby make compatibility of the resin β with the resin α favorable and maintain a higher mechanical durability. The incorporation of a siloxane structure at the end enables having high lubricating properties and reducing the initial friction coefficient. The reason for this is considered to be due to the following that the incorporation of a dimethylpolysiloxane (siloxane) moiety at the end allows such a siloxane portion to have a high degree of freedom and high surface migration properties and to be easily present on the surface of the photosensitive member.

In the present invention, the polycarbonate resin having a siloxane structure at the end can be a polycarbonate resin D having a structural unit represented by the following formula (A') and an end structure represented by the following formula (D). The polyester resin having a siloxane structure at the end can also be a polyester resin E having a structural unit represented by the following formula (B') and an end structure represented by the following formula (D).

(A')

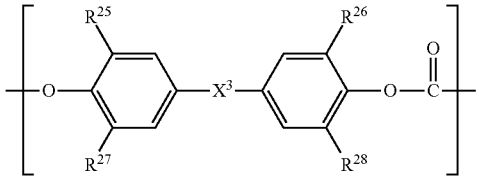

In the formula (A'), $R^{25}$ to $R^{28}$ each independently represents a hydrogen atom or a methyl group. $X^3$ represents a single bond, a cyclohexylidene group, or a divalent group having a structure represented by the following formula (C').

(B')

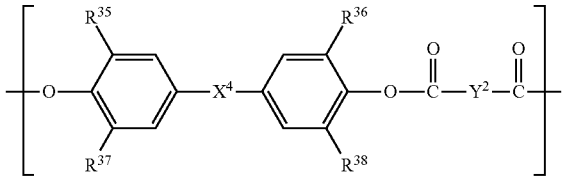

In the formula (B'), $R^{35}$ to $R^{38}$ each independently represents a hydrogen atom or a methyl group. $X^4$ represents a single bond, a cyclohexylidene group, or a divalent group having a structure represented by the following formula (C'). $Y^2$ represents a m-phenylene group, a p-phenylene group, or a divalent group in which two p-phenylene groups are bound to each other via an oxygen atom.

(C')

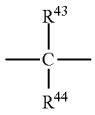

In the formula (C'), $R^{43}$ and $R^{44}$ each independently represents a hydrogen atom, a methyl group or a phenyl group.

(D)

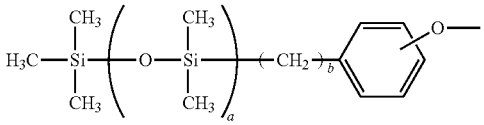

In the formula (D), a and b represent the number of the repetition of the structure within the bracket. The average value of a is not less than 20 and not more than 100, and the average value of b is not less than 1 and not more than 10, based on the polycarbonate resin D or the polyester resin E.

More preferably, the average value of a is not less than 30 and not more than 60, and the average value of b is not less than 3 and not more than 10.

In the present invention, the polycarbonate resin D and the polyester resin E have the end structure represented by the formula (D) at one end or both ends of the resin. In the case where the resin D and the resin E have the end structure represented by the formula (D) at one end, a molecular weight regulator (end terminator) is used. The molecular weight regulator includes phenol, p-cumylphenol, p-tert-butylphenol and benzoic acid. In the present invention, the molecular weight regulator can be phenol or p-tert-butylphenol.

In the case where the resin D and the resin E have the end structure represented by the formula (D) at one end, the structure at the other one end (other end structure) is a structure represented by the following formula (G-1) or (G-2).

(G-1)

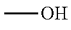

(G-2)

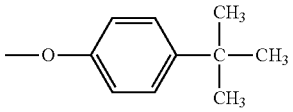

Specific examples of the end siloxane structure represented by the formula (D) are illustrated below.

(D-1)

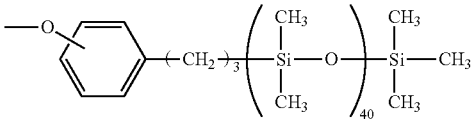

(D-2)

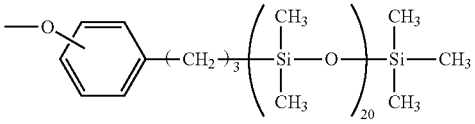

(D-3)

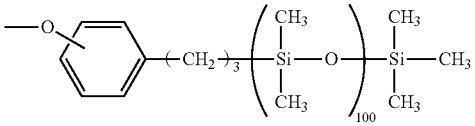

(D-4)

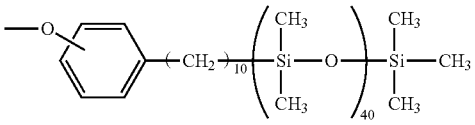

(D-5)

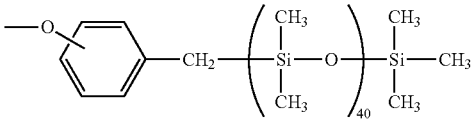

In the polycarbonate resin D, specific examples of the structural unit represented by the formula (A') include the structural units represented by the formulas (A-1) to (A-8). The structural unit represented by the formulas (A-1), (A-2) and (A-4) are preferable. In the polyester resin E, specific examples of the structural unit represented by the formula (B') include the structural units represented by the formulas (B-1) to (B-9). The structural unit represented by the formulas (B-1), (B-2), (B-3), (B-6), (B-7) and (B-8) are preferable. Among them, the structural units represented by the formulas (A-4), (B-1) and (B-3) are particularly preferable.

As the polycarbonate resin D and the polyester resin E, one or two or more of the structural units represented by formulas (A-1) to (A-8) or the structural units represented by formulas (B-1) to (B-9) can be used alone, can be mixed, or can be used as a copolymer. The copolymerization forms of the polycarbonate resin D and the polyester resin E may be any of block copolymerization, random copolymerization, alternating copolymerization and the like. The polycarbonate resin D and the polyester resin E may also have the structural unit having a siloxane structure in the main chain, and may also be, for example, a copolymer having a structural unit containing a siloxane structure represented by the following formula (H).

(H)

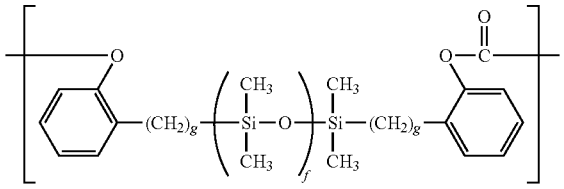

In the formula (H), f and g represent the number of the repetition of the structure within the bracket. The average value of f can be not less than 20 and not more than 100, and the average value of g can be not less than 1 and not more than 10, based on the polycarbonate resin D or the polyester resin E. Specific structural units as the structural unit represented by the formula (H) include the formulas (H-1) and (H-2).

In the present invention, the siloxane moiety in the polycarbonate resin D and the polyester resin E refers to a moiety in a dotted flame of an end structure represented by the following formula (D-S). In the case where the polycarbonate resin D and the polyester resin E have the structural unit represented by the formula (H), a structure in a dotted flame of a structural unit represented by the following formula (H-S) is also included in the siloxane moiety.

(D-S)

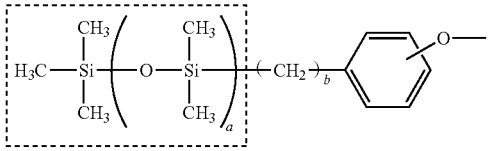

(H-S)

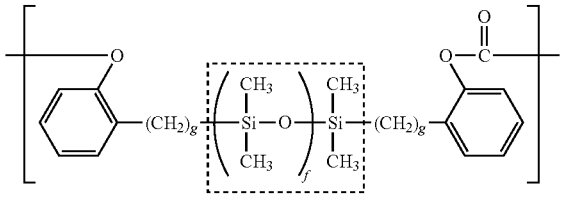

In the present invention, the polycarbonate resin D and the polyester resin E can be synthesized by any known method, and can be synthesized by the method described in, for example, Japanese Patent Application Laid-Open No. 2007-199688. Also in the present invention, the same method was used and raw materials according to the polycarbonate resin D and the polyester resin E were used, thereby synthesizing the polycarbonate resin D and the polyester resin E shown in Synthesis Examples in Table 2. Herein, the polycarbonate resin D and the polyester resin E were purified as follows: the resin D and the resin E were fractioned and separated from each other by using size exclusion chromatography, and then each fractioned component was measured by means of $^1$H-NMR to determine a composition of each resin by the relative ratio of the siloxane structure in each resin. The weight average molecular weights and the contents of the siloxane moieties in the synthesized polycarbonate resin D and the polyester resin E are shown in Table 2.

Specific examples of the polycarbonate resin D and the polyester resin E are shown below.

TABLE 2

| Component [β] (Polycarbonate resin D · Polyester resin E) | Repeating structural unit in main chain | Siloxane structure at end | Other end structure | Content of siloxane moiety (% by mass) | Weight average molecular weight (Mw) |
|---|---|---|---|---|---|
| Resin D(1) | (A-4) | (D-1) | — | 23% | 50,000 |
| Resin D(2) | (A-2) | (D-5) | — | 25% | 48,000 |
| Resin D(3) | (A-4)/(H-2) | (D-1) | — | 32% | 54,000 |
| Resin D(4) | (A-4) | (D-1) | (G-2) | 12% | 49,000 |
| Resin E(1) | (B-1) | (D-1) | — | 22% | 42,000 |

In Table 2, the mass ratio of each structural unit in the main chain in the resin D(3) satisfies (A-4):(H-2)=9:1.

In the present invention, the acrylic resin having a siloxane structure at the end can be an acrylic resin F having a structural unit represented by the following formula (F-1) and a structural unit represented by the following formula (F-2), or an acrylic resin F having a structural unit represented by the following formula (F-1) and a structural unit represented by the following formula (F-3).

(F-1)

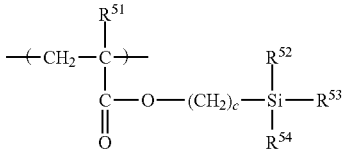

$R^{51}$ represents a hydrogen atom or a methyl group. c represents the number of the repetition of the structure within the bracket, and the average value of c is not less than 0 and not more than 5, based on the acrylic resin F. $R^{52}$ to $R^{54}$ each independently represents a structure represented by the following formula (F-1-2), a methyl group, a methoxy group or a phenyl group. At least one of $R^{52}$ to $R^{54}$ has a structure represented by the following structure (F-1-2).

(F-1-2)

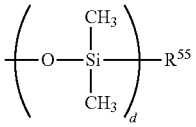

In the formula (F-1-2), d represents the number of the repetition of the structure within the bracket, and the average value of d is not less than 10 and not more than 50, based on the acrylic resin F. $R^{55}$ represents a hydroxyl group or a methyl group.

(F-2)

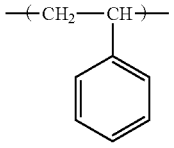

(F-3)

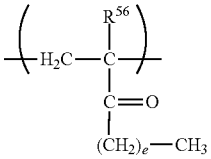

In the formula (F-3), $R^{56}$ represents a hydrogen atom, a methyl group or a phenyl group. e represents 0 or 1.

In the present invention, the siloxane moiety in the acrylic resin F refers to a moiety in a dotted flame of a structure represented by the following formula (F-S) or formula (F-T).

(F-S)

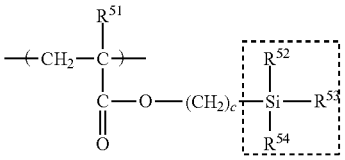

(F-T)

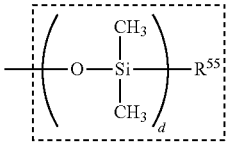

Specific examples of the structural unit in the acrylic resin F are shown in Table 3 below.

TABLE 3

| Compound Example | (F-1) | (F-2) or (F-3) | Weight ratio of repeating structure units | Weight average molecular weight Mw |
|---|---|---|---|---|
| F-A | 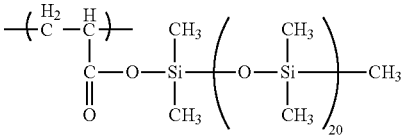 | 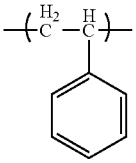 | 2/8 | 105,000 |

TABLE 3-continued

| Compound Example | (F-1) | (F-2) or (F-3) | Weight ratio of repeating structure units | Weight average molecular weight Mw |
|---|---|---|---|---|
| F-B | 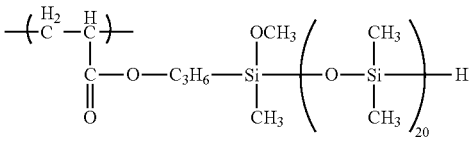 | 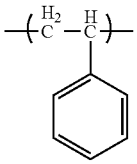 | 2/8 | 100,000 |
| F-C | 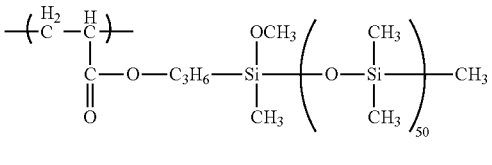 | 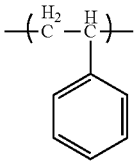 | 1/9 | 100,000 |
| F-D | 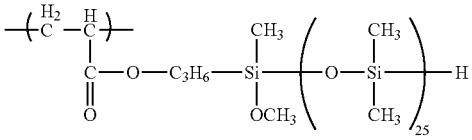 | 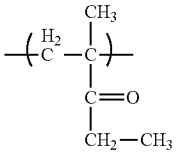 | 1/9 | 105,000 |
| F-E | 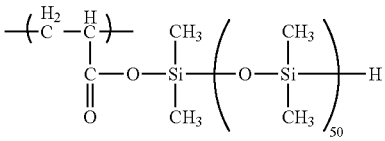 | 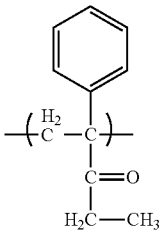 | 2/8 | 110,000 |
| F-F | 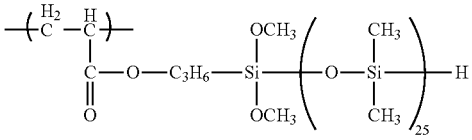 | 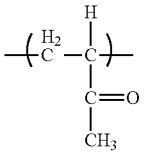 | 1.5/8.5 | 100,000 |
| F-G | 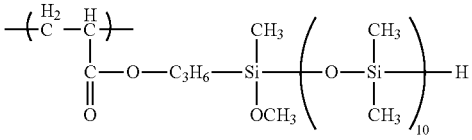 | 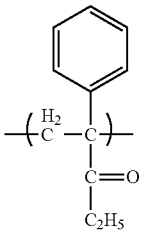 | 1/9 | 110,000 |

Among the acrylic resins F represented by the above Table 3, resins represented by Compound Examples (F-B) and (F-E) are preferable.

These acrylic resins can be synthesized by any known method, for example, the method described in Japanese Patent Application Laid-Open No. S58-167606 or Japanese Patent Application Laid-Open No. S62-75462.

The content of the resin β contained in the surface layer of the electrophotographic photosensitive member according to the present invention is preferably not less than 0.1% by mass and not more than 50% by mass based on the total mass of the resin α, from the viewpoints of the reduction in initial friction coefficient and the suppression of the variation in bright portion potential due to the repeating use. The content is more preferably not less than 1% by mass and not more than 50% by mass.

<Regarding Compound γ>

The surface layer of the present invention includes as the compound γ, at least one of propylene carbonate, γ-butyrolactone, δ-valerolactone and ϵ-caprolactone.

The surface layer includes these compounds γ to thereby obtain the effect of suppressing the variation in bright portion potential due to the repeating use. The content of the compound γ can be not less than 0.001% by mass and not more than 1% by mass based on the total mass of the surface layer, thereby simultaneously better satisfying the reduction in initial friction coefficient and the suppression of the variation in bright portion potential due to the repeating use, and making abrasion resistance favorable.

In the present invention, a coat is formed by allowing the compound γ to be contained in a surface-layer coating solution, coating the surface-layer coating solution on the support, and heating and drying the resultant, and thereby the surface layer including the compound γ is formed.

In the present invention, since the compound γ is easily volatilized by a step of heating and drying a coat at the time of forming the surface layer, the content of the compound γ in the surface-layer coating solution can be larger than the content of the compound γ contained in the surface layer in consideration of the volatile portion.

Therefore, the content of the compound γ in the surface-layer coating solution is preferably not less than 5% by mass and not more than 50% by mass, and more preferably not less than 5% by mass and not more than 15% by mass, based on the total mass of the surface-layer coating solution.

The content of the compound γ in the surface layer can be measured by the following method. The content was measured by using HP7694 Headspace sampler (manufactured by Agilent Technologies) and HP6890 series GS System (manufactured by Agilent Technologies). The produced electrophotographic photosensitive member was cut out to a piece of 5 mm×40 mm (sample piece), the piece was placed into a vial, Headspace sampler (HP7694 Headspace sampler) was set as follows: the temperature of Oven was 150° C., the temperature of Loop was 170° C., and the temperature of Transfer Line 190° C.; and generated gas was measured by gas chromatography (HP6890 series GS System). The mass of the surface layer was determined by the difference between the mass of the sample piece with the surface layer, taken out from the vial, and the mass of the sample piece from which the surface layer was then peeled off. The sample piece from which the surface layer was peeled off was a sample piece obtained by dipping the taken out sample piece in methylethyl ketone for 5 minutes to peel off only the surface layer of the sample piece, and then drying the resultant at 100° C. for 5 minutes. Also in the present invention, the content of the compound γ in the surface layer was measured by using the above-described method.

Then, the configuration of the electrophotographic photosensitive member according to the present invention will be described.

The electrophotographic photosensitive member according to the present invention includes a support and a photosensitive layer formed on the support. The photosensitive layer includes a one-layer type photosensitive layer containing a charge transport substance and a charge generation substance in one layer; and a laminate type (functional separation type) photosensitive layer in which a charge generation layer containing a charge generation substance and a charge transport layer containing a charge transport substance are separated from each other. The laminate type photosensitive layer can be used in the present invention. The charge generation layer may have a laminated structure, and the charge transport layer may have a laminated configuration. For the purpose of enhancing durability of the electrophotographic photosensitive member, a protective layer may be formed on the photosensitive layer.

With respect to the surface layer of the electrophotographic photosensitive member according to the present invention, when the charge transport layer is the topmost surface, the charge transport layer is the surface layer, and on the other hand, when the protective layer is provided on the charge transport layer, the protective layer is the surface layer.

<Conductive Support>

The support means a support having conductivity (conductive support). Examples of the support include supports made of metals such as aluminum, stainless, copper, nickel and zinc or alloys of such metals. In the case where the support is made of aluminum or an aluminum alloy, an ED pipe, an EI pipe, or a pipe obtained by subjecting these pipes to cutting, electrolytic composite polishing (electrolysis with an electrode having electrolytic action and an electrolytic solution and polishing with a grinding stone having polishing action), and a wet-process or dry-process honing treatment can also be used. The support also includes a support made of metal and a support where a conductive material such as aluminum, an aluminum alloy or an indium oxide-tin oxide alloy is formed on a resin support in the form of a thin film.

A support where conductive particles such as carbon black, tin oxide particles, titanium oxide particles or silver particles are impregnated with a resin or the like, and a support made of a plastic having a conductive binder resin can also be used.

For the purpose of preventing interference fringes caused by scattering of laser light or the like, the surface of the conductive support may be subjected to a cutting, surface roughening or alumite treatment.

In the electrophotographic photosensitive member according to the present invention, a conductive layer having conductive particles and a resin may be provided on the support. The conductive layer is a layer obtained by using a conductive-layer coating solution in which conductive particles are dispersed in a binder resin.

The conductive particles include carbon black, acetylene black, powders of metals such as aluminum, nickel, iron, nichrome, copper, zinc and silver, and powders of metal oxides such as conductive tin oxide and ITO.

The binder resin to be used for the conductive layer includes a polyester resin, a polycarbonate resin, polyvinylbutyral, an acrylic resin, a silicone resin, an epoxy resin, a melamine resin, a urethane resin, a phenol resin and an alkyd resin.

The solvent for the conductive-layer coating solution includes an ether-type solvent, an alcohol-type solvent, a ketone-type solvent and an aromatic hydrocarbon solvent. The film thickness of the conductive layer is preferably not less than 0.2 μm and 40 μm or less, more preferably not less than 1 μm and not more than 35 μm, and still more preferably not less than 5 μm and not more than 30 μm.

An intermediate layer may be provided between the conductive support or the conductive layer and the photosensitive layer. The intermediate layer is formed for improving the adhesion properties of the photosensitive layer, coating properties, and charge injection properties from the conductive support, and protecting the photosensitive layer against electric fracture.

The intermediate layer can be formed by applying an intermediate-layer coating solution containing a binder resin on the conductive support or the conductive layer, and drying or curing the resultant.

The binder resin of the intermediate layer includes polyacrylic acids, methylcellulose, ethylcellulose, a polyamide resin, a polyimide resin, a polyamideimide resin, a polyamide acid resin, a melamine resin, an epoxy resin and a polyurethane resin. The binder resin to be used for the intermediate layer can be a thermoplastic resin, and can be specifically a thermoplastic polyamide resin. The polyamide resin can be a low crystalline or non-crystalline copolymerized nylon so as to be applied in the state of a solution.

The solvent for the intermediate-layer coating solution includes an ether-type solvent, an alcohol-type solvent, a ketone-type solvent and an aromatic hydrocarbon solvent. The film thickness of the intermediate layer is preferably not less than 0.05 μm and not more than 40 μm, and more preferably not less than 0.1 μm and not more than 30 μm. The intermediate layer may contain semi-conductive particles or an electron transport substance, or an electron-accepting substance.

<Photosensitive Layer>

The photosensitive layer (charge generation layer, charge transport layer) is formed on the conductive support, the conductive layer or the intermediate layer.

The charge generation substance to be used for the electrophotographic photosensitive member according to the present invention includes an azo pigment, a phthalocyanine pigment, an indigo pigment and a perylene pigment. One or two or more of such charge generation substances may be used. Among them, oxytitanium phthalocyanine, hydroxygallium phthalocyanine and chlorogallium phthalocyanine are particularly preferable because of a high sensitivity.

The binder resin to be used for the charge generation layer includes a polycarbonate resin, a polyester resin, a butyral resin, a polyvinylacetal resin, an acrylic resin, a vinyl acetate resin and a urea resin. Among them, a butyral resin is particularly preferable. One or two or more of the above resins can be used alone, can be mixed, or can be used as a copolymer.

The charge generation layer can be formed by applying an charge generation-layer coating solution obtained by dispersing a charge generation substance along with a binder resin and a solvent and drying the resultant. The charge generation layer may be a film formed by vapor depositing the charge generation substance.

Examples of a dispersing method includes a method using a homogenizer, an ultrasonic wave, a ball mill, a sand mill, an attritor or a roll mill.

With respect to the proportion of the charge generation substance to the binder resin, the proportion of the charge generation substance is preferably within a range of not less than 0.1 parts by mass and not more than 10 parts by mass, and more preferably not less than 1 part by mass and not more than 3 parts by mass, based on 1 part by mass of the resin.

The solvent to be used for the charge generation-layer coating solution includes an alcohol-type solvent, a sulfoxide-type solvent, a ketone-type solvent, an ether-type solvent, an ester-type solvent or an aromatic hydrocarbon solvent.

The film thickness of the charge generation layer is preferably not less than 0.01 μm and not more than 5 μm, and more preferably not less than 0.1 μm and not more than 2 μm.

A variety of sensitizers, antioxidants, ultraviolet absorbers plasticizers and the like can also be added to the charge generation layer where necessary. In order not to interrupt the flow of a charge (carrier) in the charge generation layer, the charge generation layer may contain the electron transport substance and the electron-accepting substance.

In the electrophotographic photosensitive member including the laminate type photosensitive layer, the charge transport layer is provided on the charge generation layer.

The charge transport substance to be used in the present invention includes a triarylamine compound, a hydrazone compound, a styryl compound and a stilbene compound. The charge transport substance can be any of compounds represented by the following structural formulas (CTM-1) to (CTM-7).

(CTM-1)

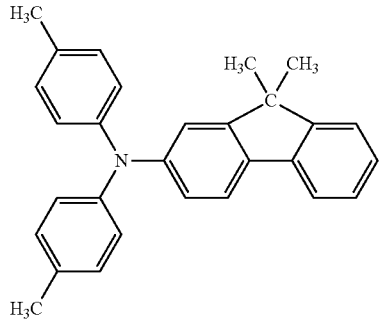

(CTM-2)

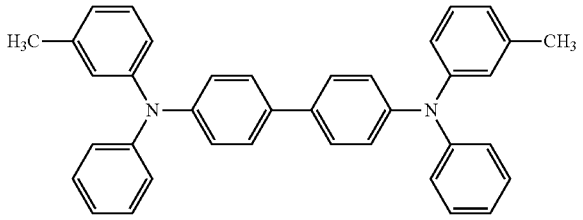

(CTM-3)

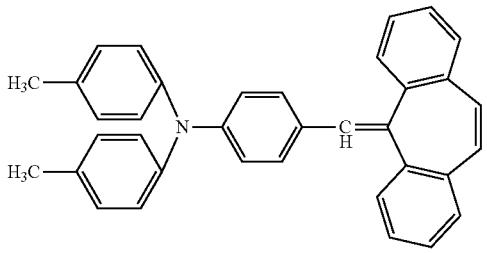

(CTM-4)

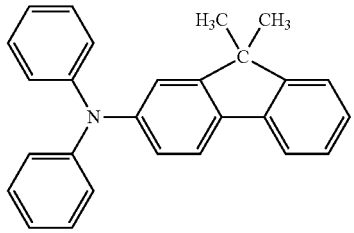

(CTM-5)

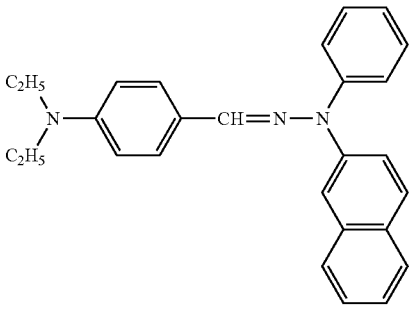

-continued (CTM-6)

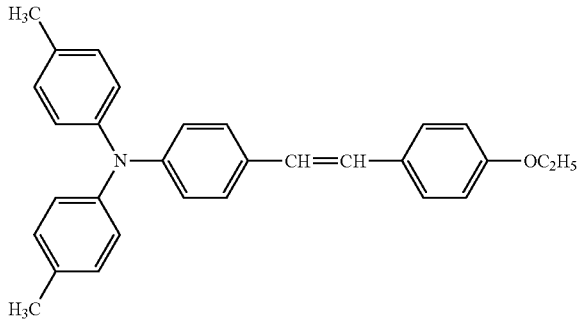

(CTM-7)

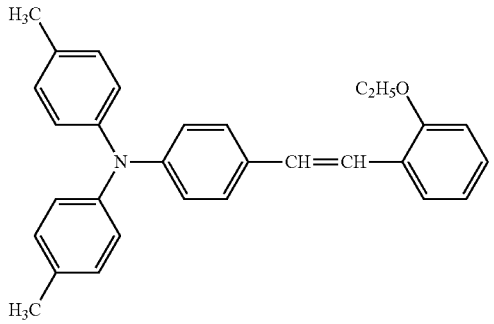

The charge transport layer can be formed by applying the charge transport-layer coating solution obtained by dissolving the charge transport substance and the binder resin in the solvent, and drying the resultant.

In the present invention, when the charge transport layer is the surface layer, the binder resin containing the resin α and the resin β is used, and may be used while being further mixed with other resin. Such other resin to be mixed that may be used is described above.

The film thickness of the charge transport layer is preferably 5 to 50 μm, and more preferably 10 to 30 μm. The mass ratio of the charge transport substance to the binder resin is 5:1 to 1:5, and is preferably 3:1 to 1:3.

The solvent to be used for the charge transport-layer coating solution includes an alcohol-type solvent, a sulfoxide-type solvent, a ketone-type solvent, an ether-type solvent, an ester-type solvent and an aromatic hydrocarbon solvent. The solvent can be xylene, toluene or tetrahydrofuran.

A variety of additives may be added to the respective layers of the electrophotographic photosensitive member according to the present invention. Examples of the additives include degradation inhibitors such as an antioxidant, an ultraviolet absorber and a light stabilizer, and fine particles such as organic fine particles and inorganic fine particles.

The degradation inhibitors include hindered phenol-type antioxidants, hindered amine-type light stabilizers, sulfur atom-containing antioxidants and phosphorus atom-containing antioxidants.

The organic fine particles include fluorine atom-containing resin particles, and polymer resin particles such as polystyrene fine particles and polyethylene resin particles. Examples of the inorganic fine particles include metal oxides such as silica and alumina.

When the above respective layer coating solutions are applied, any coating method such as a dip coating method, a spray coating method, a spinner coating method, a roller coating method, a Meyer bar coating method and a blade coating method can be used. Among the methods, a dip coating method can be used.

The drying temperature for drying the above respective layer coating solutions to form the respective coats can be 60° C. or higher and 150° C. or lower. In particular, the drying temperature for drying the charge transport-layer coating solution (surface-layer coating solution) can be 110° C. or higher and 140° C. or lower. The drying time is preferably 10 to 60 minutes, and more preferably 20 to 60 minutes.

[Electrophotographic Apparatus]

FIGURE illustrates one example of a schematic structure of an electrophotographic apparatus provided with a process cartridge having the electrophotographic photosensitive member according to the present invention.

In FIGURE, reference number 1 denotes a cylindrical electrophotographic photosensitive member, which is rotatably driven at a predetermined circumferential speed around an axis 2 in the direction shown by an arrow. The surface of the electrophotographic photosensitive member 1 to be rotatably driven is uniformly charged to a predetermined negative potential by a charging unit (primary charging unit: charging roller or the like) 3 in the course of rotation. Then, the charged electrophotographic photosensitive member is subjected to exposure light (image exposure light) 4 which is emitted from an exposure unit (not illustrated) such as a slit exposure unit or a laser beam scanning exposure unit and whose intensity has been modulated according to the time-series electric digital image signal of the intended image information. In this way, an electrostatic latent image according to the intended image is sequentially formed on the surface of the electrophotographic photosensitive member 1.

The electrostatic latent image formed on the surface of the electrophotographic photosensitive member 1 is developed with a toner contained in a developer of a developing unit 5 by reverse developing to be formed into a toner image. Then, the toner image formed and supported on the surface of the electrophotographic photosensitive member 1 is sequentially transferred to a transfer material (paper or the like) P with a transfer bias from a transferring unit (transfer roller or the like) 6. Herein, the transfer material P is taken out from a transfer material feed unit (not illustrated) in synchronous with the rotation of the electrophotographic photosensitive member 1, and fed to a portion (abutting portion) between the electrophotographic photosensitive member 1 and the transferring unit 6. A bias voltage having a polarity opposite to the polarity of the charge possessed by the toner is applied to the transferring unit 6 from a bias supply (not illustrated).

The transfer material P to which the toner image is transferred is separated from the surface of the electrophotographic photosensitive member 1 and conveyed to a fixing unit 8, and is subjected to a treatment of fixing the toner image and conveyed outside the apparatus as an image-formed material (printed or copied material).

The surface of the electrophotographic photosensitive member 1, on which the toner image is transferred, is cleaned by a cleaning unit (cleaning blade or the like) 7 so that a transfer residual developer (post-transfer residual toner) is removed. Then, the surface is subjected to a neutralization treatment with pre-exposure light (not illustrated) from a pre-exposure unit (not illustrated), and thereafter repeatedly used for image forming. Herein, when the charging unit 3 is a contact charging unit using a charging roller or the like as illustrated in FIGURE, such pre-exposing is not necessarily required.

In the present invention, a plurality of constituent elements selected from the electrophotographic photosensitive member 1, the charging unit 3, the developing unit 5, the transferring unit 6, the cleaning unit 7 and the like may be accommodated in a container to be integrally supported as a process cartridge. Such a process cartridge may be detachably attachable to the main body of the electrophotographic apparatus such as a copier or a laser beam printer. In FIGURE, the electrophotographic photosensitive member 1, the charging unit 3, the developing unit 5 and the cleaning unit 7 are integrally supported to be formed into a cartridge, and thus set up to a process cartridge 9 detachably attachable to the main body of the electrophotographic apparatus by using a guiding unit 10 such as a rail provided in the main body of the electrophotographic apparatus.

EXAMPLES

Hereinafter, the present invention will be described in more detail with reference to specific Examples and Comparative Examples. It is to be noted that the present invention is not limited to the Examples and Comparative Examples. Herein, "part(s)" in Examples is meant to be "part(s) by mass".

Example 1

An aluminum cylinder of 24 mm in diameter and 261.6 mm in length was used as a support (conductive support).

Then, 10 parts of $SnO_2$-coated barium sulfate (conductive particles), 2 parts of titanium oxide (pigment for resistance modification), 6 parts of a phenol resin (binder resin), 0.001 parts of silicone oil (leveling agent) and a mixed solvent of 4 parts of methanol and 16 parts of methoxypropanol were used to prepare a conductive-layer coating solution.

The conductive-layer coating solution was applied onto the support by dip coating and cured (heat cured) at 140° C. for 30 minutes to thereby form a conductive layer having a film thickness of 15 μm.

Then, 3 parts of N-methoxymethylated nylon and 3 parts of copolymerized nylon were dissolved in a mixed solvent of 65 parts of methanol and 30 parts of n-butanol to thereby prepare an intermediate-layer coating solution.

The intermediate-layer coating solution was applied onto the conductive layer by dip coating and dried at 80° C. for 10 minutes to thereby form an intermediate layer having a film thickness of 0.7 μm.

Then, 10 parts of a hydroxygallium phthalocyanine crystal (charge generation substance) in the form of a crystal, having strong peaks at 7.5°, 9.9°, 16.3°, 18.6°, 25.1° and 28.3° of Bragg angles 2θ±0.2° in CuKα characteristic X-ray diffraction was used as a charge generation substance. This was added to a solution obtained by dissolving 5 parts of a polyvinylbutyral resin (trade name: S-LEC BX-1, produced by Sekisui Chemical Co., Ltd.) in 250 parts of cyclohexanone, and thereafter, dispersed in the solution by a sand mill apparatus using glass beads of 1 mm in diameter under an atmosphere of 23±3° C. for 1 hour, and 250 parts of ethyl acetate was added thereto to thereby prepare a charge generation-layer coating solution.

The charge generation-layer coating solution was applied onto the intermediate layer by dip coating and dried at 100° C. for 10 minutes to thereby form a charge generation layer having a film thickness of 0.26 μm.

Then, 5.6 parts of a compound represented by the formula (CTM-1) (charge transport substance), 2.4 parts of a compound represented by the formula (CTM-2) (charge transport substance), 10 parts of a polycarbonate resin A(1) (resin A(1)) and 0.36 parts of a polycarbonate resin (D1) (resin (D1)), 2.5 parts of propylene carbonate, 20 parts of dimethoxymethane, and 30 parts of o-xylene were mixed to prepare a solution, which was used as an charge transport-layer coating solution.

The charge transport-layer coating solution was applied onto the charge generation layer by dip coating and dried at 125° C. for 30 minutes to thereby form a charge transport layer having a film thickness of 15 μm. The content of propylene carbonate in the formed charge transport layer was measured by using gas chromatography according to the measuring method to be found to be 0.028% by mass.

In this way, an electrophotographic photosensitive member in which the charge transport layer was the surface layer was produced.

Hereinafter, evaluations of the resulting electrophotographic photosensitive member will be described.

The evaluations were performed for the variation in bright portion potential (potential variation) at the time of the repeating use and for the initial friction coefficient.

As an apparatus for evaluating the potential variation, HP Color Laser Jet Enterprise CP4525n manufactured by Hewlett-Packard Development Company, L.P. (process speed 240 mm/sec, to which a cylindrical electrophotographic photosensitive member of 24 mm in diameter could be mounted), which was altered so as to apply a DC bias to the electrophotographic photosensitive member by using an external supply, was used. The produced electrophotographic photosensitive member mounted to the process cartridge was placed on the station of the process cartridge, and evaluated in an environment of a temperature of 15° C. and a humidity of 10% RH.

<Evaluation of Potential Variation>

The surface potential of the electrophotographic photosensitive member (dark portion potential and bright portion potential) was measured at the position of a developing unit by using the altered cartridge in which a jig secured so as to locate a probe for potential measurement at a position 131 mm (central portion) away from the edge of the electrophotographic photosensitive member was exchanged for the developing unit. A bias to be applied was set so that the dark portion potential of the nonexposed portion of the electrophotographic photosensitive member was −500V, to measure the bright portion potential (bright portion potential V at the initial (at the start of a sheet-passing durability test)) which had been subjected to light attenuation from the dark portion potential by means of irradiation with laser light (0.37 $\mu J/cm^2$). Using plain paper of A4 size, an image was continuously output on 30,000 sheets of the paper, and the bright portion potential (bright portion potential V' after the repeating use) after such output was measured. In Example 1, the initial bright portion potential was −130 V, the bright portion potential after the repeating use was −270 V, and the variation (amount of variation in bright portion potential $\Delta V$ (=|V'|−|V|)) in bright portion potential during the repeating use was 140 V. The electrophotographic photosensitive member containing no compound γ was used as an electrophotographic photosensitive member for control, and a value calculated by subtracting the amount of variation in the bright portion potential in the Example from the amount of variation in the bright portion potential of the electrophotographic photosensitive member for control was assumed as the amount of variation in bright portion potential improved. In Example 1, the electrophotographic photosensitive member for control was assumed as the electrophotographic photosensitive member in the following Comparative Example 1.

<Measurement of Friction Coefficient>

The measurement of the friction coefficient of the electrophotographic photosensitive member produced in each of Examples and Comparative Examples was performed by the method described below. The measurement of the friction coefficient was performed by using HEIDON-14 manufactured by SHINTO Scientific Co., Ltd. under a normal temperature and normal humidity environment (23° C./50% RH). A blade (urethane rubber blade) to which a constant load was applied was placed in contact with the electrophotographic photosensitive member. A frictional force exerted between the electrophotographic photosensitive member and the rubber blade was measured when the electrophotographic photosensitive member was parallel translated at a scan speed of 50 mm/min. The frictional force was measured as the amount of strain of a strain gauge attached at the side of the urethane rubber blade and converted into a tensile load (force to be applied to the photosensitive member). The coefficient of kinetic friction was obtained from [force to be applied to photosensitive member (frictional force) (gf)]/[load applied to blade (gf)] when the urethane rubber blade was operated. The urethane rubber blade used was a urethane blade (rubber hardness: 67°) manufactured by Hokushin Industry Inc., which was cut into a piece measuring 5 mm×30 mm×2 mm, and the coefficient of kinetic friction was measured under a load of 50 g at an angle of 27° to the width direction. In Example 1, the coefficient of kinetic friction was 0.13.

Examples 2 to 5

Each electrophotographic photosensitive member was produced in the same manner as in Example 1 except that the type and content of the compound γ in Example 1 were changed to the type and content as shown in Table 4, and the reduction in initial friction coefficient and the suppression of the variation in bright portion potential due to the repeating use (amount of variation in bright portion potential, the amount of variation in bright portion potential improved) were evaluated. The results are shown in Table 12. The electrophotographic photosensitive member in Comparative Example 1 was used for the electrophotographic photosensitive member for control, as in Example 1.

Examples 6 to 11 and 17 to 40

Each electrophotographic photosensitive member was produced in the same manner as in Example 1 except that the types and contents of the resin α, the resin β, the compound γ, the charge transport substance and the solvent in Example 1 were changed to the types and contents shown in Table 4, and the reduction in initial friction coefficient and the suppression of the variation in bright portion potential due to the repeating use were evaluated. The results are shown in Table 12.

The electrophotographic photosensitive member in Comparative Example 1 was used for the electrophotographic photosensitive member for control in each of Examples 2 to 5, 17 to 24 and 38 to 40.

The electrophotographic photosensitive member in Comparative Example 5 was used for the electrophotographic photosensitive member for control in each of Examples 6 and 10.

The electrophotographic photosensitive member in Comparative Example 6 was used for the electrophotographic photosensitive member for control in each of Examples 7 and 11.

The electrophotographic photosensitive member in Comparative Example 8 was used for the electrophotographic photosensitive member for control in Example 25.

The electrophotographic photosensitive member in Comparative Example 9 was used for the electrophotographic photosensitive member for control in Example 26.

The electrophotographic photosensitive member in Comparative Example 10 was used for the electrophotographic photosensitive member for control in Example 27.

The electrophotographic photosensitive member in Comparative Example 11 was used for the electrophotographic photosensitive member for control in Example 28.

The film thicknesses of the charge transport layers in Examples 29 and 33 were 13 μm and 20 μm, respectively. The electrophotographic photosensitive member in Comparative Example 12 was used for the electrophotographic photosensitive member for control in Example 29. The film thickness of the charge transport layer in Comparative Example 12 was 13 μm.

The electrophotographic photosensitive member in Comparative Example 13 was used for the electrophotographic photosensitive member for control in each of Example 30.

The electrophotographic photosensitive member in Comparative Example 14 was used for the electrophotographic photosensitive member for control in each of Examples 31 to 33.

The electrophotographic photosensitive member in Comparative Example 15 was used for the electrophotographic photosensitive member for control in Examples 34 and 35.

The electrophotographic photosensitive member in Comparative Example 16 was used for the electrophotographic photosensitive member for control in each of Example 36.

The electrophotographic photosensitive member in Comparative Example 17 was used for the electrophotographic photosensitive member for control in Example 37.

Example 12

An electrophotographic photosensitive member was produced in the same manner as in Example 1 except that the drying temperature and time during the formation of the charge transport layer in Example 1 were changed to 145° C. and 60 minutes, and the reduction in initial friction coefficient and the suppression of the variation in bright portion potential due to the repeating use were evaluated. The results are shown in Table 12. The electrophotographic photosensitive member in Comparative Example 1 was used for the electrophotographic photosensitive member for control, as in Example 1.

Examples 13 and 14

Each electrophotographic photosensitive member was produced in the same manner as in Example 1 except that the film thickness of the charge transport layer in Example 1 was changed to 30 μm in Example 13 and changed to 10 μm in Example 14, and the reduction in initial friction coefficient and the suppression of the variation in bright portion potential due to the repeating use were evaluated. The results are shown in Table 12. The electrophotographic photosensitive member in Comparative Example 1 was used for the electrophotographic photosensitive member for control, as in Example 1.

Examples 15 and 16

Each electrophotographic photosensitive member was produced in the same manner as in Example 1 except that the drying temperature and time during the formation of the charge transport layer and the film thickness of the charge transport layer in Example 1 were changed to 130° C., 60 minutes and 10 μm in Example 16, and changed to 120° C., 20 minutes and 10 μm in Example 15, and the reduction in initial friction coefficient and the suppression of the variation in bright portion potential due to the repeating use were evaluated. The results are shown in Table 12. The electrophotographic photosensitive member in Comparative Example 1 was used for the electrophotographic photosensitive member for control, as in Example 1.

TABLE 4

| | α | | β | | CTM | | γ | | Solvent | |
|---|---|---|---|---|---|---|---|---|---|---|
| Example | Type of resin | Parts by mass | Type of resin | Parts by mass | Structure | Parts by mass | Type | Parts by mass | Type | Parts by mass |
| 1 | Resin A(1) | 10 | Resin D(1) | 0.36 | CTM-1/ CTM-2 | 5.6/2.4 | Propylene carbonate | 2.5 | o-Xylene/ Dimethoxymethane | 30/20 |
| 2 | Resin A(1) | 10 | Resin D(1) | 0.36 | CTM-1/ CTM-2 | 5.6/2.4 | γ-butyrolactone | 2.5 | o-Xylene/ Dimethoxymethane | 30/20 |
| 3 | Resin A(1) | 10 | Resin D(1) | 0.36 | CTM-1/ CTM-2 | 5.6/2.4 | Propylene carbonate/ γ-butyrolactone | 1.5/1 | o-Xylene/ Dimethoxymethane | 30/20 |
| 4 | Resin A(1) | 10 | Resin D(1) | 0.36 | CTM-1/ CTM-2 | 5.6/2.4 | δ-valerolactone | 2.5 | o-Xylene/ Dimethoxymethane | 30/20 |
| 5 | Resin A(1) | 10 | Resin D(1) | 0.36 | CTM-1/ CTM-2 | 5.6/2.4 | ϵ-caprolactone | 2.5 | o-Xylene/ Dimethoxymethane | 30/20 |
| 6 | Resin A(1) | 10 | Resin D(1) | 0.01 | CTM-1/ CTM-2 | 5.6/2.4 | Propylene carbonate | 2.5 | o-Xylene/ Dimethoxymethane | 30/20 |
| 7 | Resin A(1) | 10 | Resin D(1) | 5 | CTM-1/ CTM-2 | 5.6/2.4 | Propylene carbonate | 2.5 | o-Xylene/ Dimethoxymethane | 30/20 |
| 8 | Resin A(1) | 10 | Resin D(1) | 0.36 | CTM-1/ CTM-2 | 5.6/2.4 | Propylene carbonate | 0.5 | o-Xylene/ Dimethoxymethane | 30/20 |
| 9 | Resin A(1) | 10 | Resin D(1) | 0.36 | CTM-1/ CTM-2 | 5.6/2.4 | Propylene carbonate | 8 | o-Xylene/ Dimethoxymethane | 28/20 |
| 10 | Resin A(1) | 10 | Resin D(1) | 0.01 | CTM-1/ CTM-2 | 5.6/2.4 | Propylene carbonate | 0.5 | o-Xylene/ Dimethoxymethane | 30/20 |
| 11 | Resin A(1) | 10 | Resin D(1) | 5 | CTM-1/ CTM-2 | 5.6/2.4 | Propylene carbonate | 0.5 | o-Xylene/ Dimethoxymethane | 30/20 |
| 12 | Resin A(1) | 10 | Resin D(1) | 0.36 | CTM-1/ CTM-2 | 5.6/2.4 | Propylene carbonate | 2.5 | o-Xylene/ Dimethoxymethane | 30/20 |
| 13 | Resin A(1) | 10 | Resin D(1) | 0.36 | CTM-1/ CTM-2 | 5.6/2.4 | Propylene carbonate | 2.5 | o-Xylene/ Dimethoxymethane | 30/20 |
| 14 | Resin A(1) | 10 | Resin D(1) | 0.36 | CTM-1/ CTM-2 | 5.6/2.4 | Propylene carbonate | 2.5 | o-Xylene/ Dimethoxymethane | 30/20 |
| 15 | Resin A(1) | 10 | Resin D(1) | 0.36 | CTM-1/ CTM-2 | 5.6/2.4 | Propylene carbonate | 2.5 | o-Xylene/ Dimethoxymethane | 30/20 |
| 16 | Resin A(1) | 10 | Resin D(1) | 0.36 | CTM-1/ CTM-2 | 5.6/2.4 | Propylene carbonate | 2.5 | o-Xylene/ Dimethoxymethane | 30/20 |
| 17 | Resin A(1) | 10 | Resin D(1) | 0.36 | CTM-1/ CTM-2 | 5.6/2.4 | Propylene carbonate | 2.5 | Toluene/ Dimethoxymethane | 30/20 |
| 18 | Resin A(1) | 10 | Resin D(1) | 0.36 | CTM-1/ CTM-2 | 5.6/2.4 | Propylene carbonate | 2.5 | m-Xylene/ Dimethoxymethane | 30/20 |
| 19 | Resin A(1) | 10 | Resin D(1) | 0.36 | CTM-1/ CTM-2 | 5.6/2.4 | Propylene carbonate | 2.5 | p-Xylene/ Dimethoxymethane | 30/20 |
| 20 | Resin A(1) | 10 | Resin D(1) | 0.36 | CTM-1/ CTM-2 | 5.6/2.4 | Propylene carbonate | 2.5 | o-Xylene/Toluene/ Dimethoxymethane | 15/15/20 |
| 21 | Resin A(1) | 10 | Resin D(1) | 0.36 | CTM-1/ CTM-2 | 5.6/2.4 | Propylene carbonate | 2.5 | Mixed xylene/ Dimethoxymethane | 30/20 |
| 22 | Resin A(1) | 10 | Resin D(1) | 0.36 | CTM-1/ CTM-2 | 5.6/2.4 | Propylene carbonate | 2.5 | Toluene/THF | 30/20 |
| 23 | Resin A(1) | 10 | Resin D(1) | 0.36 | CTM-1/ CTM-2 | 5.6/2.4 | Propylene carbonate | 2.5 | o-Xylene/ | 50 |
| 24 | Resin A(1) | 10 | Resin D(1) | 0.36 | CTM-1/ CTM-2 | 5.6/2.4 | Propylene carbonate | 2.5 | o-Xylene/ Dimethoxymethane | 20/30 |
| 25 | Resin A(1) | 10 | Resin D(2) | 0.36 | CTM-1/ CTM-2 | 5.6/2.4 | Propylene carbonate | 2.5 | o-Xylene/ Dimethoxymethane | 30/20 |
| 26 | Resin A(1) | 10 | Resin D(3) | 0.36 | CTM-1/ CTM-2 | 5.6/2.4 | Propylene carbonate | 2.5 | o-Xylene/ Dimethoxymethane | 30/20 |
| 27 | Resin A(1) | 10 | Resin D(4) | 0.36 | CTM-1/ CTM-2 | 5.6/2.4 | Propylene carbonate | 2.5 | o-Xylene/ Dimethoxymethane | 30/20 |
| 28 | Resin A(1) | 10 | Resin E(1) | 0.36 | CTM-1/ CTM-2 | 5.6/2.4 | Propylene carbonate | 2.5 | o-Xylene/ Dimethoxymethane | 30/20 |
| 29 | Resin A(1)/ Resin A(2) | 8/2 | Resin D(1) | 0.36 | CTM-1/ CTM-2 | 5.6/2.4 | Propylene carbonate | 2.5 | o-Xylene/ Dimethoxymethane | 30/20 |
| 30 | Resin A(1)/ Resin A(7) | 9/1 | Resin D(1) | 0.1 | CTM-1/ CTM-2 | 5.6/2.4 | Propylene carbonate | 2.5 | o-Xylene/ Dimethoxymethane | 30/20 |
| 31 | Resin A(3) | 10 | Resin D(1) | 0.36 | CTM-1/ CTM-2 | 5.6/2.4 | Propylene carbonate | 2.5 | o-Xylene/ Dimethoxymethane | 40/30 |
| 32 | Resin A(3) | 10 | Resin D(1) | 0.36 | CTM-1/ CTM-2 | 4/4 | Propylene carbonate | 2.5 | o-Xylene/ Dimethoxymethane | 40/30 |
| 33 | Resin A(3) | 10 | Resin D(1) | 0.36 | CTM-1/ CTM-3 | 7.2/0.8 | Propylene carbonate | 2.5 | o-Xylene/ Dimethoxymethane | 40/30 |
| 34 | Resin A(3)/ Resin A(8) | 9/1 | Resin D(1) | 0.1 | CTM-1/ CTM-2 | 5.6/2.4 | Propylene carbonate | 2.5 | o-Xylene/ Dimethoxymethane | 40/30 |
| 35 | Resin A(3)/ Resin A(8) | 9/1 | Resin D(1) | 0.1 | CTM-1/ CTM-3 | 7.2/0.8 | Propylene carbonate | 2.5 | o-Xylene/ Dimethoxymethane | 40/30 |
| 36 | Resin A(4) | 10 | Resin D(1) | 0.36 | CTM-1/ CTM-2 | 5.6/2.4 | Propylene carbonate | 2.5 | o-Xylene/ Dimethoxymethane | 30/20 |

TABLE 4-continued

| | α | | β | | CTM | | γ | | Solvent | |
|---|---|---|---|---|---|---|---|---|---|---|
| Example | Type of resin | Parts by mass | Type of resin | Parts by mass | Structure | Parts by mass | Type | Parts by mass | Type | Parts by mass |
| 37 | Resin A(5) | 10 | Resin D(1) | 0.36 | CTM-1/ CTM-2 | 5.6/2.4 | Propylene carbonate | 2.5 | o-Xylene/ Dimethoxymethane | 30/20 |
| 38 | Resin A(1) | 10 | Resin D(1) | 0.36 | CTM-1/ CTM-2 | 5.6/2.4 | Propylene carbonate | 18 | o-Xylene/ Dimethoxymethane | 12/20 |
| 39 | Resin A(3)/ Resin A(8) | 9/1 | Resin D(1) | 0.09 | CTM-1/ CTM-2 | 7.2/0.8 | Propylene carbonate | 14 | o-Xylene/ Dimethoxymethane | 21/35 |
| 40 | Resin B(1)/ Resin A(3)/ Resin A(8) | 5/4/1 | Resin D(1) | 0.095 | CTM-1/ CTM-3 | 8.1/0.9 | Propylene carbonate | 15 | o-Xylene/ Dimethoxymethane | 22.5/37.5 |

Comparative Examples 1 to 17

Each electrophotographic photosensitive member was produced in the same manner as in Example 1 except that the types and contents of the resin α, the resin β, the compound γ (Comparative Compound), the charge transport substance and the solvent in Example 1 were changed to the types and contents shown in Table 5, and the reduction in initial friction coefficient and the suppression of the variation in bright portion potential due to the repeating use were evaluated. The results are shown in Table 13. The film thickness of the charge transport layer in Comparative Example 12 was 13 μm.

Comparative Examples 18 and 19

Each electrophotographic photosensitive member was produced in the same manner as in Example 1 except that the resin β in Example 1 was changed to a dimethyl silicone oil (KF-96-100cs produced by Shin-Etsu Chemical Co., Ltd.) as shown in Table 5, and the resin α and the compound γ in Example 1 were changed as shown in Table 5. The reduction in initial friction coefficient and the suppression of the variation in bright portion potential due to the repeating use were evaluated. The results are shown in Table 13.

TABLE 5

| | α | | β | | CTM | | γ/Comparative Compound | | Solvent | |
|---|---|---|---|---|---|---|---|---|---|---|
| Comparative Example | Type of resin | Parts by mass | Type of resin | Parts by mass | Structure | Parts by mass | Type | Parts by mass | Type | Parts by mass |
| 1 | Resin A(1) | 10 | Resin D(1) | 0.36 | CTM-1/ CTM-2 | 5.6/2.4 | — | — | o-Xylene/ Dimethoxymethane | 30/20 |
| 2 | Resin A(1) | 10 | Resin D(1) | 0.36 | CTM-1/ CTM-2 | 5.6/2.4 | Monoglyme | | o-Xylene/ Dimethoxymethane | 30/20 |
| 3 | Resin A(1) | 10 | Resin D(1) | 0.36 | CTM-1/ CTM-2 | 5.6/2.4 | Diisobutyl ketone | | o-Xylene/ Dimethoxymethane | 30/20 |
| 4 | Resin A(1) | 10 | Resin D(1) | 0.36 | CTM-1/ CTM-2 | 5.6/2.4 | n-Pentyl acetate | 2.5 | o-Xylene/ Dimethoxymethane | 30/20 |
| 5 | Resin A(1) | 10 | Resin D(1) | 0.01 | CTM-1/ CTM-2 | 5.6/2.4 | — | — | o-Xylene/ Dimethoxymethane | 30/20 |
| 6 | Resin A(1) | 10 | Resin D(1) | 5 | CTM-1/ CTM-2 | 5.6/2.4 | — | — | o-Xylene/ Dimethoxymethane | 30/20 |
| 7 | Resin A(1) | 10 | Resin D(1) | 0.36 | CTM-1/ CTM-2 | 5.6/2.4 | — | — | Toluene/THF | 30/20 |
| 8 | Resin A(1) | 10 | Resin D(2) | 0.36 | CTM-1/ CTM-2 | 5.6/2.4 | — | — | o-Xylene/ Dimethoxymethane | 30/20 |
| 9 | Resin A(1) | 10 | Resin D(3) | 0.36 | CTM-1/ CTM-2 | 5.6/2.4 | — | — | o-Xylene/ Dimethoxymethane | 30/20 |
| 10 | Resin A(1) | 10 | Resin D(4) | 0.36 | CTM-1/ CTM-2 | 5.6/2.4 | — | — | o-Xylene/ Dimethoxymethane | 30/20 |
| 11 | Resin A(1) | 10 | Resin E(1) | 0.36 | CTM-1/ CTM-2 | 5.6/2.4 | — | — | o-Xylene/ Dimethoxymethane | 30/20 |
| 12 | Resin A(1)/ Resin A(2) | 8/2 | Resin D(1) | 0.36 | CTM-1/ CTM-2 | 5.6/2.4 | — | — | o-Xylene/ Dimethoxymethane | 30/20 |
| 13 | Resin A(1)/ Resin A(7) | 9/1 | Resin D(1) | 0.1 | CTM-1/ CTM-2 | 5.6/2.4 | — | — | o-Xylene/ Dimethoxymethane | 30/20 |
| 14 | Resin A(3) | 10 | Resin D(1) | 0.36 | CTM-1/ CTM-2 | 5.6/2.4 | — | — | o-Xylene/ Dimethoxymethane | 40/30 |
| 15 | Resin A(3)/ Resin A(8) | 9/1 | Resin D(1) | 0.1 | CTM-1/ CTM-3 | 7.2/0.8 | — | — | o-Xylene/ Dimethoxymethane | 40/30 |
| 16 | Resin A(4) | 10 | Resin D(1) | 0.36 | CTM-1/ CTM-2 | 5.6/2.4 | — | — | o-Xylene/ Dimethoxymethane | 30/20 |
| 17 | Resin A(5) | 10 | Resin D(1) | 0.36 | CTM-1/ CTM-2 | 5.6/2.4 | — | — | o-Xylene/ Dimethoxymethane | 30/20 |
| 18 | Resin A(1) | 10 | KF-96-CSS | 0.01 | CTM-1/ CTM-2 | 5.6/2.4 | Propylene carbonate | 2.5 | o-Xylene/ Dimethoxymethane | 30/20 |
| 19 | Resin A(1) | 10 | KF-96-CSS | 0.01 | CTM-1/ CTM-2 | 5.6/2.4 | — | — | o-Xylene/ Dimethoxymethane | 30/20 |

Examples 41 to 77

Each electrophotographic photosensitive member was produced in the same manner as in Example 1 except that the types and contents of the resin α, the resin β, the compound γ, the charge transport substance and the solvent in Example 1 were changed to the types and contents shown in Table 6, and the reduction in initial friction coefficient and the suppression of the variation in bright portion potential due to the repeating use were evaluated. The results are shown in Table 14.

The electrophotographic photosensitive member in Comparative Example 20 was used for the electrophotographic photosensitive member for control in each of Examples 41 to 46, 49, 50, 55 and 58.

The electrophotographic photosensitive member in Comparative Example 24 was used for the electrophotographic photosensitive member for control in each of Examples 47 and 51.

The electrophotographic photosensitive member in Comparative Example 25 was used for the electrophotographic photosensitive member for control in each of Examples 48 and 52.

The electrophotographic photosensitive member in Comparative Example 26 was used for the electrophotographic photosensitive member for control in each of Example 53.

The electrophotographic photosensitive member in Comparative Example 27 was used for the electrophotographic photosensitive member for control in Example 54.

The electrophotographic photosensitive member in Comparative Example 28 was used for the electrophotographic photosensitive member for control in Example 56.

The electrophotographic photosensitive member in Comparative Example 29 was used for the electrophotographic photosensitive member for control in Example 57.

The electrophotographic photosensitive member in Comparative Example 30 was used for the electrophotographic photosensitive member for control in each of Examples 59 to 63, 66 and 67.

The electrophotographic photosensitive member in Comparative Example 34 was used for the electrophotographic photosensitive member for control in each of Example 64 and Example 68.

The electrophotographic photosensitive member in Comparative Example 35 was used for the electrophotographic photosensitive member for control in each of Example 65 and Example 69.

The electrophotographic photosensitive member in Comparative Example 36 was used for the electrophotographic photosensitive member for control in Example 70.

The electrophotographic photosensitive member in Comparative Example 37 was used for the electrophotographic photosensitive member for control in Example 71.

The electrophotographic photosensitive member in Comparative Example 38 was used for the electrophotographic photosensitive member for control in each of Examples 72 to 77.

Example 78

An electrophotographic photosensitive member was produced in the same manner as in Example 1 except that the additive in Example 1 was changed to an additive containing 0.8 parts of a compound represented by the following formula (AD-1) and 0.2 parts of a compound represented by the following formula (AD-2), and the types and contents of the resin α, the resin β, the compound γ and the charge transport substance in Example 1 were changed to the types and contents shown in Table 6, and the reduction in initial friction coefficient and the suppression of the variation in bright portion potential due to the repeating use were evaluated. The results are shown in Table 14. The electrophotographic photosensitive member in Comparative Example 44 was used for the electrophotographic photosensitive member for control.

(AD-1)

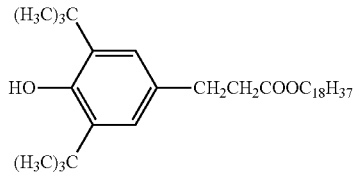

(AD-2)

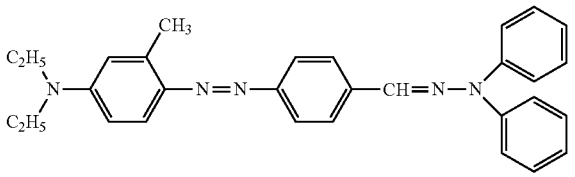

TABLE 6

| | α | | β | | CTM | | γ | | Solvent | |
|---|---|---|---|---|---|---|---|---|---|---|
| Example | Type of resin | Parts by mass | Type of resin | Parts by mass | Structure | Parts by mass | Type | Parts by mass | Type | Parts by mass |
| 41 | Resin B(1) | 10 | Resin D(1) | 0.36 | CTM-1/ CTM-2 | 5.6/2.4 | Propylene carbonate | 2.5 | o-Xylene/ Dimethoxymethane | 45/30 |
| 42 | Resin B(1) | 10 | Resin D(1) | 0.36 | CTM-1/ CTM-2 | 8.1/0.9 | Propylene carbonate | 2.5 | o-Xylene/ Dimethoxymethane | 45/30 |
| 43 | Resin B(1) | 10 | Resin D(1) | 0.36 | CTM-1/ CTM-2 | 5.6/2.4 | γ-butyrolactone | 2.5 | o-Xylene/ Dimethoxymethane | 45/30 |
| 44 | Resin B(1) | 10 | Resin D(1) | 0.36 | CTM-1/ CTM-2 | 5.6/2.4 | Propylene carbonate/ γ-butyrolactone | 1.5/1 | o-Xylene/ Dimethoxymethane | 45/30 |
| 45 | Resin B(1) | 10 | Resin D(1) | 0.36 | CTM-1/ CTM-2 | 5.6/2.4 | δ-valerolactone | 2.5 | o-Xylene/ Dimethoxymethane | 45/30 |
| 46 | Resin B(1) | 10 | Resin D(1) | 0.36 | CTM-1/ CTM-2 | 5.6/2.4 | ε-caprolactone | 2.5 | o-Xylene/ Dimethoxymethane | 45/30 |
| 47 | Resin B(1) | 10 | Resin D(1) | 0.01 | CTM-1/ CTM-2 | 5.6/2.4 | Propylene carbonate | 2.5 | o-Xylene/ Dimethoxymethane | 45/30 |
| 48 | Resin B(1) | 10 | Resin D(1) | 5 | CTM-1/ CTM-2 | 5.6/2.4 | Propylene carbonate | 2.5 | o-Xylene/ Dimethoxymethane | 45/30 |

TABLE 6-continued

| | α | | β | | CTM | | γ | | Solvent | |
|---|---|---|---|---|---|---|---|---|---|---|
| Example | Type of resin | Parts by mass | Type of resin | Parts by mass | Structure | Parts by mass | Type | Parts by mass | Type | Parts by mass |
| 49 | Resin B(1) | 10 | Resin D(1) | 0.36 | CTM-1/ CTM-2 | 5.6/2.4 | Propylene carbonate | 0.5 | o-Xylene/ Dimethoxymethane | 45/30 |
| 50 | Resin B(1) | 10 | Resin D(1) | 0.36 | CTM-1/ CTM-2 | 5.6/2.4 | Propylene carbonate | 8 | o-Xylene/ Dimethoxymethane | 40/27 |
| 51 | Resin B(1) | 10 | Resin D(1) | 0.01 | CTM-1/ CTM-2 | 5.6/2.4 | Propylene carbonate | 0.5 | o-Xylene/ Dimethoxymethane | 45/30 |
| 52 | Resin B(1) | 10 | Resin D(1) | 5 | CTM-1/ CTM-2 | 5.6/2.4 | Propylene carbonate | 0.5 | o-Xylene/ Dimethoxymethane | 45/30 |
| 53 | Resin B(1) | 10 | Resin D(1) | 0.36 | CTM-1/ CTM-2 | 5.6/2.4 | Propylene carbonate | 2.5 | Toluene/ Dimethoxymethane | 45/30 |
| 54 | Resin B(1) | 10 | Resin D(1) | 0.36 | CTM-1/ CTM-2 | 5.6/2.4 | Propylene carbonate | 2.5 | Toluene/ THF | 45/30 |
| 55 | Resin B(1) | 10 | Resin D(1) | 0.36 | CTM-1/ CTM-2 | 5.6/2.4 | Propylene carbonate | 2.5 | o-Xylene/ Dimethoxymethane | 30/45 |
| 56 | Resin B(1) | 10 | Resin D(2) | 0.36 | CTM-1/ CTM-2 | 5.6/2.4 | Propylene carbonate | 2.5 | o-Xylene/ Dimethoxymethane | 45/30 |
| 57 | Resin B(1) | 10 | Resin E(1) | 0.36 | CTM-1/ CTM-2 | 5.6/2.4 | Propylene carbonate | 2.5 | o-Xylene/ Dimethoxymethane | 45/30 |
| 58 | Resin B(1) | 10 | Resin D(1) | 0.36 | CTM-1/ CTM-2 | 5.6/2.4 | Propylene carbonate | 27 | o-Xylene/ Dimethoxymethane | 18/30 |
| 59 | Resin B(2) | 10 | Resin D(1) | 0.36 | CTM-1/ CTM-2 | 5.6/2.4 | Propylene carbonate | 2.5 | o-Xylene/ Dimethoxymethane | 60/40 |
| 60 | Resin B(2) | 10 | Resin D(1) | 0.36 | CTM-1/ CTM-2 | 5.6/2.4 | γ-butyrolactone | 2.5 | o-Xylene/ Dimethoxymethane | 60/40 |
| 61 | Resin B(2) | 10 | Resin D(1) | 0.36 | CTM-1/ CTM-2 | 5.6/2.4 | Propylene carbonate/ γ-butyrolactone | 1.5/1 | o-Xylene/ Dimethoxymethane | 60/40 |
| 62 | Resin B(2) | 10 | Resin D(1) | 0.36 | CTM-1/ CTM-2 | 5.6/2.4 | δ-valerolactone | 2.5 | o-Xylene/ Dimethoxymethane | 60/40 |
| 63 | Resin B(2) | 10 | Resin D(1) | 0.36 | CTM-1/ CTM-2 | 5.6/2.4 | ε-caprolactone | 2.5 | o-Xylene/ Dimethoxymethane | 60/40 |
| 64 | Resin B(2) | 10 | Resin D(1) | 0.01 | CTM-1/ CTM-2 | 5.6/2.4 | Propylene carbonate | 2.5 | o-Xylene/ Dimethoxymethane | 60/40 |
| 65 | Resin B(2) | 10 | Resin D(1) | 5 | CTM-1/ CTM-2 | 5.6/2.4 | Propylene carbonate | 2.5 | o-Xylene/ Dimethoxymethane | 60/40 |
| 66 | Resin B(2) | 10 | Resin D(1) | 0.36 | CTM-1/ CTM-2 | 5.6/2.4 | Propylene carbonate | 0.5 | o-Xylene/ Dimethoxymethane | 60/40 |
| 67 | Resin B(2) | 10 | Resin D(1) | 0.36 | CTM-1/ CTM-2 | 5.6/2.4 | Propylene carbonate | 8 | o-Xylene/ Dimethoxymethane | 56/38 |
| 68 | Resin B(2) | 10 | Resin D(1) | 0.01 | CTM-1/ CTM-2 | 5.6/2.4 | Propylene carbonate | 0.5 | o-Xylene/ Dimethoxymethane | 60/40 |
| 69 | Resin B(2) | 10 | Resin D(1) | 5 | CTM-1/ CTM-2 | 5.6/2.4 | Propylene carbonate | 0.5 | o-Xylene/ Dimethoxymethane | 60/40 |
| 70 | Resin B(2) | 10 | Resin D(1) | 0.36 | CTM-1/ CTM-2 | 5.6/2.4 | Propylene carbonate | 2.5 | Toluene/ Dimethoxymethane | 60/40 |
| 71 | Resin B(2) | 10 | Resin D(1) | 0.36 | CTM-1/ CTM-2 | 5.6/2.4 | Propylene carbonate | 2.5 | Toluene/ THF | 50/50 |
| 72 | Resin B(3) | 10 | Resin D(1) | 0.36 | CTM-1/ CTM-2 | 5.6/2.4 | Propylene carbonate | 2.5 | o-Xylene/ Dimethoxymethane | 60/40 |
| 73 | Resin B(3) | 10 | Resin D(1) | 0.36 | CTM-1/ CTM-2 | 5.6/2.4 | γ-butyrolactone | 2.5 | o-Xylene/ Dimethoxymethane | 60/40 |
| 74 | Resin B(3) | 10 | Resin D(1) | 0.36 | CTM-1/ CTM-2 | 5.6/2.4 | Propylene carbonate/ γ-butyrolactone | 1.5/1 | o-Xylene/ Dimethoxymethane | 60/40 |
| 75 | Resin B(3) | 10 | Resin D(1) | 0.36 | CTM-1/ CTM-2 | 5.6/2.4 | δ-valerolactone | 2.5 | o-Xylene/ Dimethoxymethane | 60/40 |
| 76 | Resin B(3) | 10 | Resin D(1) | 0.36 | CTM-1/ CTM-2 | 5.6/2.4 | ε-caprolactone | 2.5 | o-Xylene/ Dimethoxymethane | 60/40 |
| 77 | Resin B(3) | 10 | Resin D(1) | 0.36 | CTM-1/ CTM-2 | 5.6/2.4 | Propylene carbonate | 20 | o-Xylene/ Dimethoxymethane | 40/40 |
| 78 | Resin B(3)/ Resin A(6) | 7/3 | Resin D(1) | 0.36 | CTM-6/ CTM-7 | 5/2.5 | Propylene carbonate | 2.5 | Toluene/THF | 10/40 |

Comparative Examples 20 to 43

Each electrophotographic photosensitive member was produced in the same manner as in Example 1 except that the types and contents of the constituent elements: the resin α, the resin β, the compound γ (Comparative Compound), the charge transport substance and the solvent; in Example 1 were changed to the types and contents shown in Table 7, and the reduction in initial friction coefficient and the suppression of the variation in bright portion potential due to the repeating use were evaluated. The results are shown in Table 15.

Comparative Example 44

An electrophotographic photosensitive member was produced in the same manner as in Example 1 except that the compound γ was not contained in Example 78, and the reduction in initial friction coefficient and the suppression of the variation in bright portion potential due to the repeating use were evaluated. The results are shown in Table 15.

TABLE 7

| | α | | β | | CTM | | γ/Comparative Compound | | Solvent | |
|---|---|---|---|---|---|---|---|---|---|---|
| Comparative Example | Type of resin | Parts by mass | Type of resin | Parts by mass | Structure | Parts by mass | Type | Parts by mass | Type | Parts by mass |
| 20 | Resin B(1) | 10 | Resin D(1) | 0.36 | CTM-1/ CTM-2 | 5.6/2.4 | — | — | o-Xylene/ Dimethoxymethane | 45/30 |
| 21 | Resin B(1) | 10 | Resin D(1) | 0.36 | CTM-1/ CTM-2 | 5.6/2.4 | Monoglyme | 2.5 | o-Xylene/ Dimethoxymethane | 45/30 |
| 22 | Resin B(1) | 10 | Resin D(1) | 0.36 | CTM-1/ CTM-2 | 5.6/2.4 | Diisobutyl ketone | 2.5 | o-Xylene/ Dimethoxymethane | 45/30 |
| 23 | Resin B(1) | 10 | Resin D(1) | 0.36 | CTM-1/ CTM-2 | 5.6/2.4 | n-Pentyl acetate | 2.5 | o-Xylene/ Dimethoxymethane | 45/30 |
| 24 | Resin B(1) | 10 | Resin D(1) | 0.01 | CTM-1/ CTM-2 | 5.6/2.4 | — | — | o-Xylene/ Dimethoxymethane | 45/30 |
| 25 | Resin B(1) | 10 | Resin D(1) | 5 | CTM-1/ CTM-2 | 5.6/2.4 | — | — | o-Xylene/ Dimethoxymethane | 45/30 |
| 26 | Resin B(1) | 10 | Resin D(1) | 0.36 | CTM-1/ CTM-2 | 5.6/2.4 | — | — | Toluene/ Dimethoxymethane | 45/30 |
| 27 | Resin B(1) | 10 | Resin D(1) | 0.36 | CTM-1/ CTM-2 | 5.6/2.4 | — | — | Toluene/THF | 45/30 |
| 28 | Resin B(1) | 10 | Resin D(2) | 0.36 | CTM-1/ CTM-2 | 5.6/2.4 | — | — | o-Xylene/ Dimethoxymethane | 45/30 |
| 29 | Resin B(1) | 10 | Resin E(1) | 0.36 | CTM-1/ CTM-2 | 5.6/2.4 | — | — | o-Xylene/ Dimethoxymethane | 45/30 |
| 30 | Resin B(2) | 10 | Resin D(1) | 0.36 | CTM-1/ CTM-2 | 5.6/2.4 | — | — | o-Xylene/ Dimethoxymethane | 60/40 |
| 31 | Resin B(2) | 10 | Resin D(1) | 0.36 | CTM-1/ CTM-2 | 5.6/2.4 | Monoglyme | 2.5 | o-Xylene/ Dimethoxymethane | 45/30 |
| 32 | Resin B(2) | 10 | Resin D(1) | 0.36 | CTM-1/ CTM-2 | 5.6/2.4 | Diisobutyl ketone | 2.5 | o-Xylene/ Dimethoxymethane | 45/30 |
| 33 | Resin B(2) | 10 | Resin D(1) | 0.36 | CTM-1/ CTM-2 | 5.6/2.4 | n-Pentyl acetate | 2.5 | o-Xylene/ Dimethoxymethane | 45/30 |
| 34 | Resin B(2) | 10 | Resin D(1) | 0.1 | CTM-1/ CTM-3 | 5.6/2.4 | — | — | o-Xylene/ Dimethoxymethane | 45/30 |
| 35 | Resin B(4) | 10 | Resin D(1) | 5 | CTM-1/ CTM-2 | 5.6/2.4 | — | — | o-Xylene/ Dimethoxymethane | 45/30 |
| 36 | Resin B(2) | 10 | Resin D(1) | 0.36 | CTM-1/ CTM-2 | 5.6/2.4 | — | — | Toluene/ Dimethoxymethane | 60/40 |
| 37 | Resin B(2) | 10 | Resin D(1) | 0.36 | CTM-1/ CTM-2 | 5.6/2.4 | — | — | Toluene/THF | 50/50 |
| 38 | Resin B(3) | 10 | Resin D(1) | 0.36 | CTM-1/ CTM-2 | 5.6/2.4 | — | — | o-Xylene/ Dimethoxymethane | 60/40 |
| 39 | Resin B(3) | 10 | Resin D(1) | 0.36 | CTM-1/ CTM-2 | 5.6/2.4 | Monoglyme | 2.5 | o-Xylene/ Dimethoxymethane | 60/40 |
| 40 | Resin B(3) | 10 | Resin D(1) | 0.36 | CTM-1/ CTM-2 | 5.6/2.4 | Diisobutyl ketone | 2.5 | o-Xylene/ Dimethoxymethane | 60/40 |
| 41 | Resin B(3) | 10 | Resin D(1) | 0.36 | CTM-1/ CTM-2 | 5.6/2.4 | n-Pentyl acetate | 2.5 | o-Xylene/ Dimethoxymethane | 60/40 |
| 42 | Resin B(3) | 10 | Resin D(1) | 0.36 | CTM-1/ CTM-2 | 5.6/2.4 | — | — | Toluene/ Dimethoxymethane | 60/40 |
| 43 | Resin B(3) | 10 | Resin D(1) | 0.36 | CTM-1/ CTM-2 | 5.6/2.4 | — | — | Toluene/THF | 50/50 |
| 44 | Resin B(3)/ Resin A(6) | 10 | Resin D(1) | 0.36 | CTM-6/ CTM-7 | 5/2.5 | — | — | Toluene/THF | 10/40 |

Examples 79 to 149

Each electrophotographic photosensitive member was produced in the same manner as in Example 1 except that the types and contents of the resin α, the resin β, the compound γ, the charge transport substance and the solvent in Example 1 were changed to the types and contents shown in Tables 8, 9 and 10, and the reduction in initial friction coefficient and the suppression of the variation in bright portion potential due to the repeating use were evaluated. The results are shown in Table 16.

The film thickness of the charge transport layer in each of Examples 80, 97, 101, 121, 123, 125, and 140 was 25 μm.

The electrophotographic photosensitive member in Comparative Example 45 was used for the electrophotographic photosensitive member for control in each of Examples 79 to 84, 87, 88, 91 to 93, 102, and 103.

The electrophotographic photosensitive member in Comparative Example 49 was used for the electrophotographic photosensitive member for control in each of Examples 85 and 89.

The electrophotographic photosensitive member in Comparative Example 50 was used for the electrophotographic photosensitive member for control in each of Examples 86 and 90.

The electrophotographic photosensitive member in Comparative Example 52 was used for the electrophotographic photosensitive member for control in Example 94.

The electrophotographic photosensitive member in Comparative Example 53 was used for the electrophotographic photosensitive member for control in each of Examples 95 to 97.

The electrophotographic photosensitive member in Comparative Example 54 was used for the electrophotographic photosensitive member for control in each of Examples 98 and 99.

The electrophotographic photosensitive member in Comparative Example 55 was used for the electrophotographic photosensitive member for control in each of Examples 100 and 101.

TABLE 8

| | α | | β | | CTM | | γ | | Solvent | |
|---|---|---|---|---|---|---|---|---|---|---|
| Example | Type of resin | Parts by mass | Type of resin | Parts by mass | Structure | Parts by mass | Type | Parts by mass | Type | Parts by mass |
| 79 | Resin A(1) | 10 | F-B | 0.18 | CTM-1/ CTM-2 | 5.6/2.4 | Propylene carbonate | 2.5 | o-Xylene/ Dimethoxymethane | 30/20 |
| 80 | Resin A(1) | 10 | F-B | 0.18 | CTM-5 | 9.5 | Propylene carbonate | 2.5 | o-Xylene/ Dimethoxymethane | 30/20 |
| 81 | Resin A(1) | 10 | F-B | 0.18 | CTM-1/ CTM-2 | 5.6/2.4 | γ-butyrolactone | 2.5 | o-Xylene/ Dimethoxymethane | 30/20 |
| 82 | Resin A(1) | 10 | F-B | 0.18 | CTM-1/ CTM-2 | 5.6/2.4 | Propylene carbonate/ γ-butyrolactone | 1.5/1 | o-Xylene/ Dimethoxymethane | 30/20 |
| 83 | Resin A(1) | 10 | F-B | 0.18 | CTM-1/ CTM-2 | 5.6/2.4 | δ-valerolactone | 2.5 | o-Xylene/ Dimethoxymethane | 30/20 |
| 84 | Resin A(1) | 10 | F-B | 0.18 | CTM-1/ CTM-2 | 5.6/2.4 | ε-caprolactone | 2.5 | o-Xylene/ Dimethoxymethane | 30/20 |
| 85 | Resin A(1) | 10 | F-B | 0.01 | CTM-1/ CTM-2 | 5.6/2.4 | Propylene carbonate | 2.5 | o-Xylene/ Dimethoxymethane | 30/20 |
| 86 | Resin A(1) | 10 | F-B | 5 | CTM-1/ CTM-2 | 5.6/2.4 | Propylene carbonate | 2.5 | o-Xylene/ Dimethoxymethane | 30/20 |
| 87 | Resin A(1) | 10 | F-B | 0.18 | CTM-1/ CTM-2 | 5.6/2.4 | Propylene carbonate | 0.5 | o-Xylene/ Dimethoxymethane | 30/20 |
| 88 | Resin A(1) | 10 | F-B | 0.18 | CTM-1/ CTM-2 | 5.6/2.4 | Propylene carbonate | 8 | o-Xylene/ Dimethoxymethane | 30/20 |
| 89 | Resin A(1) | 10 | F-B | 0.18 | CTM-1/ CTM-2 | 5.6/2.4 | Propylene carbonate | 0.5 | o-Xylene/ Dimethoxymethane | 30/20 |
| 90 | Resin A(1)/ Resin A(7) | 9.5/0.5 | F-B | 0.18 | CTM-1/ CTM-2 | 5.6/2.4 | Propylene carbonate | 2.5 | o-Xylene/ Dimethoxymethane | 30/20 |
| 91 | Resin A(1) | 10 | F-B | 0.18 | CTM-1/ CTM-2 | 5.6/2.4 | Propylene carbonate | 2.5 | Toluene/ Dimethoxymethane | 30/20 |
| 92 | Resin A(1) | 10 | F-B | 0.18 | CTM-1/ CTM-2 | 5.6/2.4 | Propylene carbonate | 2.5 | Toluene/THF | 25/25 |
| 93 | Resin A(1) | 10 | F-B | 0.18 | CTM-1/ CTM-2 | 5.6/2.4 | Propylene carbonate | 2.5 | o-Xylene/ Dimethoxymethane | 20/30 |
| 94 | Resin A(1) | 10 | F-E | 0.18 | CTM-1/ CTM-2 | 5.6/2.4 | Propylene carbonate | 2.5 | o-Xylene/ Dimethoxymethane | 30/20 |
| 95 | Resin A(1)/ Resin A(7) | 9.5/0.5 | F-B | 0.18 | CTM-1/ CTM-3 | 7.2/0.8 | Propylene carbonate | 2.5 | o-Xylene/ Dimethoxymethane | 30/20 |
| 96 | Resin A(1)/ Resin A(7) | 9.5/0.5 | F-B | 0.18 | CTM-1/ CTM-4 | 5.6/2.4 | Propylene carbonate | 2.5 | o-Xylene/ Dimethoxymethane | 30/20 |
| 97 | Resin A(1)/ Resin A(7) | 9.5/0.5 | F-B | 0.18 | CTM-1/ CTM-3 | 7.2/0.8 | Propylene carbonate | 2.5 | o-Xylene/ Dimethoxymethane | 30/20 |
| 98 | Resin A(1)/ Resin A(7)/ Resin A(9) | 8.5/0.5/1 | F-B | 0.18 | CTM-1/ CTM-2 | 5.6/2.4 | Propylene carbonate | 2.5 | o-Xylene/ Dimethoxymethane | 30/20 |
| 99 | Resin A(1)/ Resin A(7)/ Resin A(9) | 8.5/0.5/1 | F-B | 0.18 | CTM-1/ CTM-3 | 7.2/0.8 | Propylene carbonate | 2.5 | o-Xylene/ Dimethoxymethane | 30/20 |
| 100 | Resin A(3)/ Resin A(8)/ Resin A(9) | 8.5/0.5/1 | F-B | 0.18 | CTM-1/ CTM-2 | 5.6/2.4 | Propylene carbonate | 2.5 | o-Xylene/ Dimethoxymethane | 40/30 |
| 101 | Resin A(3)/ Resin A(8)/ Resin A(9) | 8.5/0.5/1 | F-B | 0.18 | CTM-1/ CTM-3 | 7.2/0.8 | Propylene carbonate | 2.5 | o-Xylene/ Dimethoxymethane | 40/30 |
| 102 | Resin A(1) | 10 | F-B | 0.18 | CTM-1/ CTM-2 | 5.6/2.4 | Propylene carbonate | 18 | o-Xylene/ Dimethoxymethane | 12/20 |
| 103 | Resin A(3) | 10 | F-B | 0.19 | CTM-1/ CTM-3 | 8.1/0.9 | Propylene carbonate | 15 | o-Xylene/ Dimethoxymethane | 23/38 |

The electrophotographic photosensitive member in Comparative Example 56 was used for the electrophotographic photosensitive member for control in each of Examples 104 to 109, 112, 113, 116 to 118 and 126.

The electrophotographic photosensitive member in Comparative Example 60 was used for the electrophotographic photosensitive member for control in each of Example 110 and Example 114.

The electrophotographic photosensitive member in Comparative Example 61 was used for the electrophotographic photosensitive member for control in each of Example 111 and Example 115.

The electrophotographic photosensitive member in Comparative Example 63 was used for the electrophotographic photosensitive member for control in Example 119.

The electrophotographic photosensitive member in Comparative Example 64 was used for the electrophotographic photosensitive member for control in each of Examples 120 and 121.

The electrophotographic photosensitive member in Comparative Example 65 was used for the electrophotographic photosensitive member for control in each of Examples 122 and 123.

The electrophotographic photosensitive member in Comparative Example 66 was used for the electrophotographic photosensitive member for control in each of Examples 124 and 125.

TABLE 9

| | α | | β | | CTM | | γ | | Solvent | |
|---|---|---|---|---|---|---|---|---|---|---|
| Example | Type of resin | Parts by mass | Type of resin | Parts by mass | Structure | Parts by mass | Type | Parts by mass | Type | Parts by mass |
| 104 | Resin B(1) | 10 | F-B | 0.18 | CTM-1/ CTM-2 | 5.6/2.4 | Propylene carbonate | 2.5 | o-Xylene/ Dimethoxymethane | 45/30 |
| 105 | Resin B(1) | 10 | F-B | 0.18 | CTM-1/ CTM-3 | 8.1/0.9 | Propylene carbonate | 2.5 | o-Xylene/ Dimethoxymethane | 45/30 |
| 106 | Resin B(1) | 10 | F-B | 0.18 | CTM-1/ CTM-2 | 5.6/2.4 | γ-butyrolactone | 2.5 | o-Xylene/ Dimethoxymethane | 45/30 |
| 107 | Resin B(1) | 10 | F-B | 0.18 | CTM-1/ CTM-2 | 5.6/2.4 | Propylene carbonate/ γ-butyrolactone | 1.5/1 | o-Xylene/ Dimethoxymethane | 45/30 |
| 108 | Resin B(1) | 10 | F-B | 0.18 | CTM-1/ CTM-2 | 5.6/2.4 | δ-valerolactone | 2.5 | o-Xylene/ Dimethoxymethane | 45/30 |
| 109 | Resin B(1) | 10 | F-B | 0.18 | CTM-1/ CTM-2 | 5.6/2.4 | ε-caprolactone | 2.5 | o-Xylene/ Dimethoxymethane | 45/30 |
| 110 | Resin B(1) | 10 | F-B | 0.01 | CTM-1/ CTM-2 | 5.6/2.4 | Propylene carbonate | 2.5 | o-Xylene/ Dimethoxymethane | 45/30 |
| 111 | Resin B(1) | 10 | F-B | 5 | CTM-1/ CTM-2 | 5.6/2.4 | Propylene carbonate | 2.5 | o-Xylene/ Dimethoxymethane | 45/30 |
| 112 | Resin B(1) | 10 | F-B | 0.18 | CTM-1/ CTM-2 | 5.6/2.4 | Propylene carbonate | 0.5 | o-Xylene/ Dimethoxymethane | 45/30 |
| 113 | Resin B(1) | 10 | F-B | 0.18 | CTM-1/ CTM-2 | 5.6/2.4 | Propylene carbonate | 8 | o-Xylene/ Dimethoxymethane | 40/27 |
| 114 | Resin B(1) | 10 | F-B | 0.01 | CTM-1/ CTM-2 | 5.6/2.4 | Propylene carbonate | 0.5 | o-Xylene/ Dimethoxymethane | 45/30 |
| 115 | Resin B(1) | 10 | F-B | 5 | CTM-1/ CTM-2 | 5.6/2.4 | Propylene carbonate | 0.5 | o-Xylene/ Dimethoxymethane | 45/30 |
| 116 | Resin B(1) | 10 | F-B | 0.18 | CTM-1/ CTM-2 | 5.6/2.4 | Propylene carbonate | 2.5 | Toluene/ Dimethoxymethane | 45/30 |
| 117 | Resin B(1) | 10 | F-B | 0.18 | CTM-1/ CTM-2 | 5.6/2.4 | Propylene carbonate | 2.5 | Toluene/THF | 35/40 |
| 118 | Resin B(1) | 10 | F-B | 0.18 | CTM-1/ CTM-2 | 5.6/2.4 | Propylene carbonate | 2.5 | o-Xylene/ Dimethoxymethane | 30/45 |
| 119 | Resin B(1) | 10 | F-E | 0.18 | CTM-1/ CTM-3 | 5.6/2.4 | Propylene carbonate | 2.5 | o-Xylene/ Dimethoxymethane | 45/30 |
| 120 | Resin B(1)/ Resin A(9) | 9.5/0.5 | F-B | 0.18 | CTM-1/ CTM-2 | 5.6/2.4 | Propylene carbonate | 2.5 | o-Xylene/ Dimethoxymethane | 45/30 |
| 121 | Resin B(1)/ Resin A(9) | 9.5/0.5 | F-B | 0.18 | CTM-1/ CTM-3 | 7.2/0.8 | Propylene carbonate | 2.5 | o-Xylene/ Dimethoxymethane | 45/30 |
| 122 | Resin B(1)/ Resin A(1)/ Resin A(8) | 5/4/1 | F-B | 0.18 | CTM-1/ CTM-2 | 5.6/2.4 | Propylene carbonate | 2.5 | o-Xylene/ Dimethoxymethane | 45/30 |
| 123 | Resin B(1)/ Resin A(1)/ Resin A(8) | 5/4/1 | F-B | 0.18 | CTM-1/ CTM-3 | 8.1/0.9 | Propylene carbonate | 2.5 | o-Xylene/ Dimethoxymethane | 45/30 |
| 124 | Resin B(1)/ Resin A(3)/ Resin A(8) | 5/4/1 | F-B | 0.18 | CTM-1/ CTM-2 | 5.6/2.4 | Propylene carbonate | 2.5 | o-Xylene/ Dimethoxymethane | 45/30 |
| 125 | Resin B(1)/ Resin A(3)/ Resin A(8) | 5/4/1 | F-B | 0.18 | CTM-1/ CTM-3 | 8.1/0.9 | Propylene carbonate | 2.5 | o-Xylene/ Dimethoxymethane | 45/30 |
| 126 | Resin B(1) | 10 | F-B | 0.18 | CTM-1/ CTM-2 | 5.6/2.4 | Propylene carbonate | 27 | o-Xylene/ Dimethoxymethane | 18/30 |

The electrophotographic photosensitive member in Comparative Example 67 was used for the electrophotographic photosensitive member for control in each of Examples 127 to 131, 134, 135 and 139 to 141.

The electrophotographic photosensitive member in Comparative Example 71 was used for the electrophotographic photosensitive member for control in each of Example 132 and Example 136.

The electrophotographic photosensitive member in Comparative Example 72 was used for the electrophotographic photosensitive member for control in each of Example 133 and Example 137.

The electrophotographic photosensitive member in Comparative Example 73 was used for the electrophotographic photosensitive member for control in Example 138.

The electrophotographic photosensitive member in Comparative Example 67 was used for the electrophotographic photosensitive member for control in each of Examples 142 to 149.

TABLE 10

| | α | | β | | CTM | | γ | | Solvent | |
|---|---|---|---|---|---|---|---|---|---|---|
| Example | Type of resin | Parts by mass | Type of resin | Parts by mass | Structure | Parts by mass | Type | Parts by mass | Type | Parts by mass |
| 127 | Resin B(2) | 10 | F-B | 0.18 | CTM-1/ CTM-2 | 5.6/2.4 | Propylene carbonate | 2.5 | o-Xylene/ Dimethoxymethane | 60/40 |

TABLE 10-continued

| | α | | β | | CTM | | γ | | Solvent | |
|---|---|---|---|---|---|---|---|---|---|---|
| Example | Type of resin | Parts by mass | Type of resin | Parts by mass | Structure | Parts by mass | Type | Parts by mass | Type | Parts by mass |
| 128 | Resin B(2) | 10 | F-B | 0.18 | CTM-1/ CTM-2 | 5.6/2.4 | γ-butyrolactone | 2.5 | o-Xylene/ Dimethoxymethane | 60/40 |
| 129 | Resin B(2) | 10 | F-B | 0.18 | CTM-1/ CTM-2 | 5.6/2.4 | Propylene carbonate/ γ-butyrolactone | 1.5/1 | o-Xylene/ Dimethoxymethane | 60/40 |
| 130 | Resin B(2) | 10 | F-B | 0.18 | CTM-1/ CTM-2 | 5.6/2.4 | δ-valerolactone | 2.5 | o-Xylene/ Dimethoxymethane | 60/40 |
| 131 | Resin B(2) | 10 | F-B | 0.18 | CTM-1/ CTM-2 | 5.6/2.4 | ε-caprolactone | 2.5 | o-Xylene/ Dimethoxymethane | 60/40 |
| 132 | Resin B(2) | 10 | F-B | 0.01 | CTM-1/ CTM-2 | 5.6/2.4 | Propylene carbonate | 2.5 | o-Xylene/ Dimethoxymethane | 60/40 |
| 133 | Resin B(2) | 10 | F-B | 5 | CTM-1/ CTM-2 | 5.6/2.4 | Propylene carbonate | 2.5 | o-Xylene/ Dimethoxymethane | 60/40 |
| 134 | Resin B(2) | 10 | F-B | 0.18 | CTM-1/ CTM-2 | 5.6/2.4 | Propylene carbonate | 0.5 | o-Xylene/ Dimethoxymethane | 60/40 |
| 135 | Resin B(2) | 10 | F-B | 0.18 | CTM-1/ CTM-2 | 5.6/2.4 | Propylene carbonate | 8 | o-Xylene/ Dimethoxymethane | 60/40 |
| 136 | Resin B(2) | 10 | F-B | 0.01 | CTM-1/ CTM-2 | 5.6/2.4 | Propylene carbonate | 0.5 | o-Xylene/ Dimethoxymethane | 60/40 |
| 137 | Resin B(2) | 10 | F-B | 5 | CTM-1/ CTM-2 | 5.6/2.4 | Propylene carbonate | 0.5 | o-Xylene/ Dimethoxymethane | 60/40 |
| 138 | Resin B(2)/ | 10 | F-B | 0.18 | CTM-1/ CTM-2 | 5.6/2.4 | Propylene carbonate | 2.5 | Toluene Dimethoxymethane | 60/40 |
| 139 | Resin B(2) | 10 | F-B | 0.18 | CTM-1/ CTM-2 | 5.6/2.4 | Propylene carbonate | 2.5 | o-Xylene/ Dimethoxymethane | 60/40 |
| 140 | Resin B(2) | 10 | F-B | 0.18 | CTM-1/ CTM-3 | 7.2/0.8 | Propylene carbonate | 2.5 | o-Xylene/ Dimethoxymethane | 60/40 |
| 141 | Resin B(2) | 10 | F-B | 0.18 | CTM-1/ CTM-3 | 7.2/0.8 | Propylene carbonate | 30 | o-Xylene/ Dimethoxymethane | 20/40 |
| 142 | Resin B(3) | 10 | F-B | 0.18 | CTM-1/ CTM-2 | 5.6/2.4 | Propylene carbonate | 2.5 | o-Xylene/ Dimethoxymethane | 60/40 |
| 143 | Resin B(3) | 10 | F-B | 0.18 | CTM-1/ CTM-2 | 5.6/2.4 | γ-butyrolactone | 2.5 | o-Xylene/ Dimethoxymethane | 60/40 |
| 144 | Resin B(3) | 10 | F-B | 0.18 | CTM-1/ CTM-2 | 5.6/2.4 | Propylene carbonate/ γ-butyrolactone | 2.5 | o-Xylene/ Dimethoxymethane | 60/40 |
| 145 | Resin B(3) | 10 | F-B | 0.18 | CTM-1/ CTM-2 | 5.6/2.4 | δ-valerolactone | 2.5 | o-Xylene/ Dimethoxymethane | 60/40 |
| 146 | Resin B(3) | 10 | F-B | 0.18 | CTM-1/ CTM-2 | 5.6/2.4 | ε-caprolactone | 2.5 | o-Xylene/ Dimethoxymethane | 60/40 |
| 147 | Resin B(3) | 10 | F-B | 0.18 | CTM-1/ CTM-2 | 5.6/2.4 | Propylene carbonate | 2.5 | Toluene/THF | 50/50 |
| 148 | Resin B(3) | 10 | F-B | 0.18 | CTM-1/ CTM-2 | 5.6/2.4 | Propylene carbonate | 2.5 | Toluene/ Dimethoxymethane | 60/40 |
| 149 | Resin B(3) | 10 | F-B | 0.18 | CTM-1/ CTM-2 | 5.6/2.4 | Propylene carbonate | 36 | o-Xylene/ Dimethoxymethane | 24/40 |

Comparative Examples 45 to 78

Each electrophotographic photosensitive member was produced in the same manner as in Example 1 except that the types and contents of the resin α, the resin β, the compound γ (Comparative Compound), the charge transport substance and the solvent in Example 1 were changed to the types and contents shown in Table 11, and the reduction in initial friction coefficient and the suppression of the variation in bright portion potential due to the repeating use were evaluated. The results are shown in Table 17.

TABLE 11

| | α | | β | | CTM | | γ/Comparative Compound | | Solvent | |
|---|---|---|---|---|---|---|---|---|---|---|
| Comparative Example | Type of resin | Parts by mass | Type of resin | Parts by mass | Structure | Parts by mass | Type | Parts by mass | Type | Parts by mass |
| 45 | Resin A(1) | 10 | F-B | 0.18 | CTM-1/ CTM-2 | 5.6/2.4 | — | — | o-Xylene/ Dimethoxymethane | 30/20 |
| 46 | Resin A(1) | 10 | F-B | 0.18 | CTM-1/ CTM-2 | 5.6/2.4 | Monoglyme | 2.5 | o-Xylene/ Dimethoxymethane | 30/20 |
| 47 | Resin A(1) | 10 | F-B | 0.18 | CTM-1/ CTM-2 | 5.6/2.4 | Diisobutyl ketone | 2.5 | o-Xylene/ Dimethoxymethane | 30/20 |
| 48 | Resin A(1) | 10 | F-B | 0.18 | CTM-1/ CTM-2 | 5.6/2.4 | n-Pentyl acetate | 2.5 | o-Xylene/ Dimethoxymethane | 30/20 |
| 49 | Resin A(1) | 10 | F-B | 0.01 | CTM-1/ CTM-2 | 5.6/2.4 | — | — | o-Xylene/ Dimethoxymethane | 30/20 |
| 50 | Resin A(1) | 10 | F-B | 5 | CTM-1/ CTM-2 | 5.6/2.4 | — | — | o-Xylene/ Dimethoxymethane | 30/20 |

TABLE 11-continued

| | α | | β | | CTM | | γ/Comparative Compound | | Solvent | |
|---|---|---|---|---|---|---|---|---|---|---|
| Comparative Example | Type of resin | Parts by mass | Type of resin | Parts by mass | Structure | Parts by mass | Type | Parts by mass | Type | Parts by mass |
| 51 | Resin A(1) | 10 | F-B | 5 | CTM-1/ CTM-2 | 5.6/2.4 | — | — | Toluene/THF | 25/25 |
| 52 | Resin A(1) | 10 | F-E | 5 | CTM-1/ CTM-2 | 5.6/2.4 | — | — | o-Xylene/ Dimethoxymethane | 30/20 |
| 53 | Resin A(1)/ Resin A(7) | 9.5/0.5 | F-B | 0.18 | CTM-1/ CTM-2 | 5.6/2.4 | — | — | o-Xylene/ Dimethoxymethane | 30/20 |
| 54 | Resin A(1)/ Resin A(7)/ Resin A(9) | 8.5/0.5/1 | F-B | 0.18 | CTM-1/ CTM-2 | 5.6/2.4 | — | — | o-Xylene/ Dimethoxymethane | 30/20 |
| 55 | Resin A(3)/ Resin A(8)/ Resin A(9) | 8.5/0.5/1 | F-B | 0.18 | CTM-1/ CTM-2 | 5.6/2.4 | — | — | o-Xylene/ Dimethoxymethane | 40/30 |
| 56 | Resin B(1) | 10 | F-B | 0.18 | CTM-1/ CTM-2 | 5.6/2.4 | — | — | o-Xylene/ Dimethoxymethane | 45/30 |
| 57 | Resin B(1) | 10 | F-B | 0.18 | CTM-1/ CTM-2 | 5.6/2.4 | Monoglyme | 2.5 | o-Xylene/ Dimethoxymethane | 45/30 |
| 58 | Resin B(1) | 10 | F-B | 0.18 | CTM-1/ CTM-2 | 5.6/2.4 | Diisobutyl ketone | 2.5 | o-Xylene/ Dimethoxymethane | 45/30 |
| 59 | Resin B(1) | 10 | F-B | 0.18 | CTM-1/ CTM-2 | 5.6/2.4 | n-Pentyl acetate | 2.5 | o-Xylene/ Dimethoxymethane | 45/30 |
| 60 | Resin B(1) | 10 | F-B | 0.01 | CTM-1/ CTM-2 | 5.6/2.4 | — | — | o-Xylene/ Dimethoxymethane | 45/30 |
| 61 | Resin B(1) | 10 | F-B | 5 | CTM-1/ CTM-2 | 5.6/2.4 | — | — | o-Xylene/ Dimethoxymethane | 45/30 |
| 62 | Resin B(1) | 10 | F-B | 0.18 | CTM-1/ CTM-2 | 5.6/2.4 | — | — | Toluene/THF | 35/40 |
| 63 | Resin B(1) | 10 | F-E | 0.18 | CTM-1/ CTM-2 | 5.6/2.4 | — | — | o-Xylene/ Dimethoxymethane | 45/30 |
| 64 | Resin B(1)/ Resin A(9) | 9.5/0.5 | F-B | 0.18 | CTM-1/ CTM-3 | 7.2/0.8 | — | — | o-Xylene/ Dimethoxymethane | 45/30 |
| 65 | Resin B(1)/ Resin A(1)/ Resin A(8) | 5/4/1 | F-B | 0.18 | CTM-1/ CTM-3 | 8.1/0.9 | — | — | o-Xylene/ Dimethoxymethane | 45/30 |
| 66 | Resin B(1)/ Resin A(3)/ Resin A(8) | 5/4/1 | F-B | 0.18 | CTM-1/ CTM-3 | 8.1/0.9 | — | — | o-Xylene/ Dimethoxymethane | 45/30 |
| 67 | Resin B(2) | 10 | F-B | 0.18 | CTM-1/ CTM-2 | 5.6/2.4 | — | — | o-Xylene/ Dimethoxymethane | 60/40 |
| 68 | Resin B(2) | 10 | F-B | 0.18 | CTM-1/ CTM-2 | 5.6/2.4 | Monoglyme | 2.5 | o-Xylene/ Dimethoxymethane | 60/40 |
| 69 | Resin B(2) | 10 | F-B | 0.18 | CTM-1/ CTM-2 | 5.6/2.4 | Diisobutyl ketone | 2.5 | o-Xylene/ Dimethoxymethane | 60/40 |
| 70 | Resin B(2) | 10 | F-B | 0.18 | CTM-1/ CTM-2 | 5.6/2.4 | n-Pentyl acetate | 2.5 | o-Xylene/ Dimethoxymethane | 60/40 |
| 71 | Resin B(2) | 10 | F-B | 0.01 | CTM-1/ CTM-2 | 5.6/2.4 | — | — | o-Xylene/ Dimethoxymethane | 60/40 |
| 72 | Resin B(2) | 10 | F-B | 5 | CTM-1/ CTM-2 | 5.6/2.4 | — | — | o-Xylene/ Dimethoxymethane | 60/40 |
| 73 | Resin B(2) | 10 | F-B | 0.18 | CTM-1/ CTM-2 | 5.6/2.4 | — | — | Toluene/THF | 60/40 |
| 74 | Resin B(3) | 10 | F-B | 0.18 | CTM-1/ CTM-2 | 5.6/2.4 | — | — | o-Xylene/ Dimethoxymethane | 60/40 |
| 75 | Resin B(3) | 10 | F-B | 0.18 | CTM-1/ CTM-2 | 5.6/2.4 | Monoglyme | 2.5 | o-Xylene/ Dimethoxymethane | 60/40 |
| 76 | Resin B(3) | 10 | F-B | 0.18 | CTM-1/ CTM-2 | 5.6/2.4 | Diisobutyl ketone | 2.5 | o-Xylene/ Dimethoxymethane | 60/40 |
| 77 | Resin B(3) | 10 | F-B | 0.18 | CTM-1/ CTM-2 | 5.6/2.4 | n-Pentyl acetate | 2.5 | o-Xylene/ Dimethoxymethane | 60/40 |
| 78 | Resin B(3) | 10 | F-B | 0.18 | CTM-1/ CTM-2 | 5.6/2.4 | — | — | Toluene/THF | 50/50 |

TABLE 12

| Example | Coefficient of kinetic friction | Initial bright portion potential (V) | Amount of variation in bright portion potential (ΔV) | Amount of (γ) in surface layer (% by mass) | Reference Example | Amount of variation in bright portion potential improved |
|---|---|---|---|---|---|---|
| Example 1 | 0.13 | −130 | 140 | 0.023 | Comparative Example 1 | 40 |
| Example 2 | 0.12 | −135 | 140 | 0.024 | Comparative Example 1 | 40 |
| Example 3 | 0.13 | −130 | 140 | 0.025 | Comparative Example 1 | 40 |

TABLE 12-continued

| Example | Coefficient of kinetic friction | Initial bright portion potential (V) | Amount of variation in bright portion potential (ΔV) | Amount of (γ) in surface layer (% by mass) | Reference Example | Amount of variation in bright portion potential improved |
|---|---|---|---|---|---|---|
| Example 4 | 0.13 | −120 | 150 | 0.024 | Comparative Example 1 | 30 |
| Example 5 | 0.14 | −140 | 145 | 0.022 | Comparative Example 1 | 35 |
| Example 6 | 0.35 | −130 | 120 | 0.022 | Comparative Example 5 | 30 |
| Example 7 | 0.11 | −130 | 165 | 0.023 | Comparative Example 6 | 25 |
| Example 8 | 0.26 | −130 | 150 | 0.011 | Comparative Example 1 | 30 |
| Example 9 | 0.14 | −130 | 120 | 0.009 | Comparative Example 1 | 60 |
| Example 10 | 0.43 | −130 | 120 | 0.001 | Comparative Example 5 | 30 |
| Example 11 | 0.12 | −130 | 150 | 0.001 | Comparative Example 6 | 40 |
| Example 12 | 0.13 | −130 | 150 | 0.023 | Comparative Example 1 | 30 |
| Example 13 | 0.16 | −125 | 150 | 0.024 | Comparative Example 1 | 30 |
| Example 14 | 0.12 | −130 | 150 | 0.025 | Comparative Example 1 | 30 |
| Example 15 | 0.17 | −130 | 160 | 0.001 | Comparative Example 1 | 20 |
| Example 16 | 0.13 | −130 | 160 | 0.048 | Comparative Example 1 | 20 |
| Example 17 | 0.14 | −135 | 135 | 0.022 | Comparative Example 1 | 45 |
| Example 18 | 0.15 | −130 | 140 | 0.023 | Comparative Example 1 | 40 |
| Example 19 | 0.16 | −125 | 140 | 0.023 | Comparative Example 1 | 40 |
| Example 20 | 0.14 | −135 | 140 | 0.025 | Comparative Example 1 | 40 |
| Example 21 | 0.15 | −130 | 130 | 0.024 | Comparative Example 1 | 50 |
| Example 22 | 0.15 | −135 | 140 | 0.026 | Comparative Example 1 | 40 |
| Example 23 | 0.12 | −130 | 140 | 0.02 | Comparative Example 1 | 40 |
| Example 24 | 0.2 | −125 | 145 | 0.024 | Comparative Example 1 | 35 |
| Example 25 | 0.18 | −150 | 185 | 0.022 | Comparative Example 8 | 45 |
| Example 26 | 0.13 | −130 | 140 | 0.029 | Comparative Example 9 | 35 |
| Example 27 | 0.23 | −140 | 140 | 0.023 | Comparative Example 10 | 35 |
| Example 28 | 0.21 | −145 | 175 | 0.026 | Comparative Example 11 | 35 |
| Example 29 | 0.15 | −135 | 135 | 0.021 | Comparative Example 12 | 35 |
| Example 30 | 0.12 | −130 | 115 | 0.025 | Comparative Example 13 | 40 |
| Example 31 | 0.16 | −90 | 135 | 0.024 | Comparative Example 14 | 50 |
| Example 32 | 0.16 | −95 | 130 | 0.023 | Comparative Example 14 | 55 |
| Example 33 | 0.17 | −95 | 135 | 0.025 | Comparative Example 14 | 50 |
| Example 34 | 0.18 | −90 | 145 | 0.002 | Comparative Example 15 | 30 |
| Example 35 | 0.18 | −90 | 140 | 0.022 | Comparative Example 15 | 35 |
| Example 36 | 0.38 | −130 | 145 | 0.025 | Comparative Example 16 | 40 |
| Example 37 | 0.15 | −130 | 150 | 0.027 | Comparative Example 17 | 35 |
| Example 38 | 0.13 | −130 | 140 | 0.85 | Comparative Example 1 | 40 |
| Example 39 | 0.16 | −120 | 130 | 0.72 | Comparative Example 1 | 50 |
| Example 40 | 0.15 | −130 | 140 | 0.75 | Comparative Example 1 | 40 |

TABLE 13

| Comparative Example | Coefficient of kinetic friction | Initial bright portion potential (V) | Amount of variation in bright portion potential (ΔV) | Amount of (γ) in surface layer (% by mass) |
|---|---|---|---|---|
| 1 | 0.4 | −120 | 180 | — |
| 2 | 0.4 | −120 | 175 | N.D |
| 3 | 0.42 | −125 | 185 | 0.051 |
| 4 | 0.41 | −125 | 185 | 0.111 |
| 5 | 0.82 | −120 | 150 | — |
| 6 | 0.38 | −120 | 190 | — |
| 7 | 0.42 | −120 | 185 | — |
| 8 | 0.5 | −160 | 230 | — |
| 9 | 0.39 | −125 | 175 | — |
| 10 | 0.5 | −115 | 175 | — |

TABLE 13-continued

| Comparative Example | Coefficient of kinetic friction | Initial bright portion potential (V) | Amount of variation in bright portion potential (ΔV) | Amount of (γ) in surface layer (% by mass) |
|---|---|---|---|---|
| 11 | 0.45 | −170 | 210 | — |
| 12 | 0.39 | −125 | 170 | — |
| 13 | 0.44 | −120 | 155 | — |
| 14 | 0.45 | −85 | 185 | — |
| 15 | 0.43 | −90 | 175 | — |
| 16 | 0.42 | −120 | 185 | — |
| 17 | 0.41 | −120 | 185 | — |
| 18 | 0.03 | −110 | 140 | 0.028 |
| 19 | 0.03 | −110 | 140 | — |

TABLE 14

| Example/ Comparative Example | Coefficient of kinetic friction | Initial bright portion potential (V) | Amount of variation in bright portion potential (ΔV) | Amount of (γ) in surface layer (% by mass) | Reference Example | Amount of variation in bright portion potential improved |
|---|---|---|---|---|---|---|
| Example 41 | 0.1 | −90 | 120 | 0.022 | Comparative Example 20 | 20 |
| Example 42 | 0.1 | −90 | 125 | 0.023 | Comparative Example 20 | 15 |
| Example 43 | 0.1 | −95 | 120 | 0.028 | Comparative Example 20 | 20 |
| Example 44 | 0.1 | −90 | 120 | 0.026 | Comparative Example 20 | 20 |

TABLE 14-continued

| Example/ Comparative Example | Coefficient of kinetic friction | Initial bright portion potential (V) | Amount of variation in bright portion potential (ΔV) | Amount of (γ) in surface layer (% by mass) | Reference Example | Amount of variation in bright portion potential improved |
|---|---|---|---|---|---|---|
| Example 45 | 0.11 | −95 | 125 | 0.022 | Comparative Example 20 | 15 |
| Example 46 | 0.12 | −95 | 120 | 0.021 | Comparative Example 20 | 20 |
| Example 47 | 0.3 | −95 | 90 | 0.026 | Comparative Example 24 | 35 |
| Example 48 | 0.08 | −100 | 140 | 0.028 | Comparative Example 25 | 40 |
| Example 49 | 0.14 | −90 | 125 | 0.001 | Comparative Example 20 | 15 |
| Example 50 | 0.1 | −90 | 100 | 0.044 | Comparative Example 20 | 45 |
| Example 51 | 0.33 | −90 | 95 | 0.001 | Comparative Example 24 | 30 |
| Example 52 | 0.12 | −90 | 150 | 0.001 | Comparative Example 25 | 30 |
| Example 53 | 0.11 | −90 | 115 | 0.022 | Comparative Example 26 | 30 |
| Example 54 | 0.09 | −90 | 125 | 0.022 | Comparative Example 27 | 15 |
| Example 55 | 0.11 | −90 | 120 | 0.022 | Comparative Example 20 | 20 |
| Example 56 | 0.15 | −105 | 190 | 0.023 | Comparative Example 28 | 30 |
| Example 57 | 0.15 | −120 | 160 | 0.025 | Comparative Example 29 | 30 |
| Example 58 | 0.12 | −90 | 120 | 0.9 | Comparative Example 20 | 20 |
| Example 59 | 0.15 | −100 | 125 | 0.034 | Comparative Example 30 | 40 |
| Example 60 | 0.16 | −100 | 125 | 0.036 | Comparative Example 30 | 40 |
| Example 61 | 0.15 | −100 | 120 | 0.003 | Comparative Example 30 | 45 |
| Example 62 | 0.14 | −100 | 130 | 0.033 | Comparative Example 30 | 35 |
| Example 63 | 0.16 | −100 | 135 | 0.033 | Comparative Example 30 | 30 |
| Example 64 | 0.33 | −105 | 100 | 0.035 | Comparative Example 34 | 40 |
| Example 65 | 0.13 | −105 | 140 | 0.033 | Comparative Example 35 | 50 |
| Example 66 | 0.2 | −95 | 125 | 0.001 | Comparative Example 30 | 40 |
| Example 67 | 0.15 | −100 | 110 | 0.052 | Comparative Example 30 | 60 |
| Example 68 | 0.35 | −100 | 110 | 0.001 | Comparative Example 34 | 30 |
| Example 69 | 0.15 | −100 | 140 | 0.001 | Comparative Example 35 | 50 |
| Example 70 | 0.15 | −100 | 125 | 0.04 | Comparative Example 36 | 45 |
| Example 71 | 0.15 | −100 | 125 | 0.038 | Comparative Example 37 | 35 |
| Example 72 | 0.17 | −100 | 130 | 0.035 | Comparative Example 38 | 20 |
| Example 73 | 0.18 | −100 | 135 | 0.03 | Comparative Example 38 | 15 |
| Example 74 | 0.18 | −105 | 130 | 0.034 | Comparative Example 38 | 20 |
| Example 75 | 0.19 | −100 | 125 | 0.036 | Comparative Example 38 | 25 |
| Example 76 | 0.17 | −95 | 130 | 0.033 | Comparative Example 38 | 20 |
| Example 77 | 0.16 | −100 | 130 | 0.9 | Comparative Example 38 | 20 |
| Example 78 | 0.25 | −100 | 140 | 0.039 | Comparative Example 44 | 40 |

TABLE 15

| Comparative Example | Coefficient of kinetic friction | Initial bright portion potential (V) | Amount of variation in bright portion potential (ΔV) | Amount of (γ) in surface layer (% by mass) |
|---|---|---|---|---|
| Comparative Example 20 | 0.36 | −85 | 140 | — |
| Comparative Example 21 | 0.4 | −85 | 145 | N.D |
| Comparative Example 22 | 0.39 | −90 | 155 | 0.048 |
| Comparative Example 23 | 0.38 | −90 | 140 | 0.09 |
| Comparative Example 24 | 0.46 | −90 | 125 | — |
| Comparative Example 25 | 0.32 | −90 | 180 | — |
| Comparative Example 26 | 0.39 | −85 | 145 | — |
| Comparative Example 27 | 0.37 | −90 | 140 | — |
| Comparative Example 28 | 0.38 | −110 | 220 | — |
| Comparative Example 29 | 0.35 | −120 | 190 | — |
| Comparative Example 30 | 0.36 | −100 | 165 | — |
| Comparative Example 31 | 0.37 | −95 | 170 | N.D |
| Comparative Example 32 | 0.35 | −90 | 160 | 0.061 |

TABLE 15-continued

| Comparative Example | Coefficient of kinetic friction | Initial bright portion potential (V) | Amount of variation in bright portion potential (ΔV) | Amount of (γ) in surface layer (% by mass) |
|---|---|---|---|---|
| Comparative Example 33 | 0.34 | −95 | 165 | 0.151 |
| Comparative Example 34 | 0.75 | −90 | 140 | — |
| Comparative Example 35 | 0.32 | −90 | 190 | — |
| Comparative Example 36 | 0.35 | −100 | 170 | — |
| Comparative Example 37 | 0.34 | −95 | 160 | — |
| Comparative Example 38 | 0.34 | −115 | 150 | — |
| Comparative Example 39 | 0.36 | −110 | 155 | N.D |
| Comparative Example 40 | 0.32 | −110 | 150 | 0.05 |
| Comparative Example 41 | 0.34 | −115 | 160 | 0.072 |
| Comparative Example 42 | 0.33 | −110 | 160 | — |
| Comparative Example 43 | 0.36 | −120 | 145 | — |
| Comparative Example 44 | 0.45 | −130 | 180 | — |

TABLE 16

| Example | Coefficient of kinetic friction | Initial bright portion potential (V) | Amount of variation in bright portion potential (ΔV) | Amount of (γ) in surface layer (% by mass) | Reference Example | Amount of variation in bright portion potential improved |
|---|---|---|---|---|---|---|
| 79 | 0.4 | −120 | 130 | 0.033 | Comparative Example 45 | 25 |
| 80 | 0.4 | −110 | 120 | 0.04 | Comparative Example 45 | 35 |
| 81 | 0.41 | −125 | 135 | 0.039 | Comparative Example 45 | 20 |
| 82 | 0.42 | −115 | 120 | 0.038 | Comparative Example 45 | 35 |
| 83 | 0.43 | −120 | 120 | 0.034 | Comparative Example 45 | 35 |
| 84 | 0.39 | −120 | 135 | 0.032 | Comparative Example 45 | 20 |
| 85 | 0.52 | −115 | 120 | 0.028 | Comparative Example 49 | 30 |
| 86 | 0.35 | −125 | 150 | 0.033 | Comparative Example 50 | 25 |
| 87 | 0.44 | −120 | 130 | 0.001 | Comparative Example 45 | 25 |
| 88 | 0.39 | −120 | 110 | 0.005 | Comparative Example 45 | 45 |
| 89 | 0.55 | −120 | 130 | 0.001 | Comparative Example 49 | 20 |
| 90 | 0.36 | −115 | 155 | 0.001 | Comparative Example 50 | 20 |
| 91 | 0.41 | −120 | 120 | 0.033 | Comparative Example 45 | 35 |
| 92 | 0.39 | −120 | 120 | 0.033 | Comparative Example 45 | 35 |
| 93 | 0.4 | −120 | 125 | 0.033 | Comparative Example 45 | 30 |
| 94 | 0.5 | −130 | 150 | 0.033 | Comparative Example 52 | 40 |
| 95 | 0.38 | −125 | 125 | 0.035 | Comparative Example 53 | 35 |
| 96 | 0.37 | −115 | 130 | 0.033 | Comparative Example 53 | 30 |
| 97 | 0.42 | −105 | 130 | 0.034 | Comparative Example 53 | 30 |
| 98 | 0.41 | −120 | 125 | 0.036 | Comparative Example 54 | 35 |
| 99 | 0.42 | −115 | 120 | 0.037 | Comparative Example 54 | 40 |
| 100 | 0.38 | −125 | 115 | 0.031 | Comparative Example 55 | 45 |
| 101 | 0.37 | −120 | 135 | 0.035 | Comparative Example 55 | 25 |
| 102 | 0.4 | −120 | 120 | 0.76 | Comparative Example 45 | 35 |
| 103 | 0.42 | −120 | 120 | 0.71 | Comparative Example 45 | 35 |
| 104 | 0.35 | −90 | 110 | 0.025 | Comparative Example 56 | 30 |
| 105 | 0.34 | −85 | 105 | 0.024 | Comparative Example 56 | 35 |
| 106 | 0.36 | −90 | 110 | 0.023 | Comparative Example 56 | 30 |
| 107 | 0.35 | −95 | 110 | 0.027 | Comparative Example 56 | 30 |
| 108 | 0.35 | −95 | 120 | 0.025 | Comparative Example 56 | 20 |
| 109 | 0.35 | −95 | 115 | 0.025 | Comparative Example 56 | 25 |
| 110 | 0.46 | −85 | 90 | 0.026 | Comparative Example 60 | 30 |
| 111 | 0.33 | −90 | 150 | 0.027 | Comparative Example 61 | 40 |
| 112 | 0.37 | −90 | 120 | 0.001 | Comparative Example 56 | 20 |
| 113 | 0.33 | −90 | 90 | 0.055 | Comparative Example 56 | 50 |

TABLE 17

| Example | Coefficient of kinetic friction | Initial bright portion potential (V) | Amount of variation in bright portion potential (ΔV) | Amount of (γ) in surface layer (% by mass) | Reference Example | Amount of variation in bright portion potential improved |
|---|---|---|---|---|---|---|
| 114 | 0.47 | −90 | 100 | 0.001 | Comparative Example 60 | 20 |
| 115 | 0.34 | −90 | 160 | 0.001 | Comparative Example 61 | 30 |
| 116 | 0.36 | −95 | 120 | 0.025 | Comparative Example 56 | 20 |
| 117 | 0.35 | −90 | 120 | 0.026 | Comparative Example 56 | 20 |
| 118 | 0.32 | −95 | 110 | 0.024 | Comparative Example 56 | 30 |
| 119 | 0.41 | −110 | 140 | 0.029 | Comparative Example 63 | 40 |
| 120 | 0.38 | −85 | 110 | 0.021 | Comparative Example 64 | 40 |
| 121 | 0.34 | −80 | 115 | 0.045 | Comparative Example 64 | 35 |
| 122 | 0.35 | −90 | 105 | 0.022 | Comparative Example 65 | 50 |
| 123 | 0.34 | −85 | 105 | 0.055 | Comparative Example 65 | 50 |
| 124 | 0.32 | −90 | 110 | 0.03 | Comparative Example 66 | 45 |
| 125 | 0.31 | −85 | 105 | 0.05 | Comparative Example 66 | 50 |
| 126 | 0.35 | −90 | 100 | 0.85 | Comparative Example 56 | 40 |
| 127 | 0.32 | −90 | 115 | 0.033 | Comparative Example 67 | 30 |
| 128 | 0.33 | −90 | 125 | 0.036 | Comparative Example 67 | 20 |
| 129 | 0.35 | −95 | 120 | 0.038 | Comparative Example 67 | 25 |
| 130 | 0.31 | −85 | 115 | 0.033 | Comparative Example 67 | 30 |
| 131 | 0.34 | −90 | 120 | 0.036 | Comparative Example 67 | 25 |
| 132 | 0.42 | −85 | 100 | 0.035 | Comparative Example 71 | 60 |
| 133 | 0.3 | −100 | 140 | 0.035 | Comparative Example 72 | 60 |
| 134 | 0.35 | −90 | 130 | 0.001 | Comparative Example 67 | 15 |
| 135 | 0.33 | −90 | 100 | 0.06 | Comparative Example 67 | 45 |
| 136 | 0.44 | −85 | 90 | 0.001 | Comparative Example 71 | 70 |
| 137 | 0.32 | −95 | 130 | 0.001 | Comparative Example 72 | 70 |
| 138 | 0.34 | −90 | 120 | 0.035 | Comparative Example 73 | 30 |
| 139 | 0.32 | −90 | 120 | 0.035 | Comparative Example 67 | 25 |
| 140 | 0.32 | −90 | 110 | 0.065 | Comparative Example 67 | 35 |
| 141 | 0.32 | −95 | 110 | 0.9 | Comparative Example 67 | 35 |
| 142 | 0.36 | −110 | 120 | 0.033 | Comparative Example 74 | 30 |
| 143 | 0.34 | −115 | 130 | 0.038 | Comparative Example 74 | 20 |
| 144 | 0.36 | −110 | 125 | 0.039 | Comparative Example 74 | 25 |
| 145 | 0.35 | −110 | 130 | 0.028 | Comparative Example 74 | 20 |
| 146 | 0.36 | −115 | 120 | 0.022 | Comparative Example 74 | 30 |
| 147 | 0.35 | −105 | 120 | 0.033 | Comparative Example 74 | 30 |
| 148 | 0.37 | −110 | 125 | 0.034 | Comparative Example 74 | 25 |
| 149 | 0.38 | −110 | 120 | 0.88 | Comparative Example 74 | 30 |

TABLE 18

| Comparative Example | Coefficient of kinetic friction | Initial bright portion potential (V) | Amount of variation in bright portion potential (ΔV) | Amount of (γ) in surface layer (% by mass) |
|---|---|---|---|---|
| 45 | 0.67 | −125 | 155 | — |
| 46 | 0.68 | −120 | 160 | N.D |
| 47 | 0.64 | −120 | 150 | 0.053 |
| 48 | 0.62 | −130 | 155 | 0.066 |
| 49 | 0.87 | −120 | 150 | — |
| 50 | 0.6 | −130 | 175 | — |
| 51 | 0.69 | −130 | 145 | — |
| 52 | 0.8 | −130 | 190 | — |
| 53 | 0.55 | −100 | 160 | — |
| 54 | 0.53 | −105 | 160 | — |
| 55 | 0.4 | −95 | 160 | — |
| 56 | 0.62 | −85 | 140 | — |
| 57 | 0.62 | −90 | 140 | N.D |
| 58 | 0.64 | −90 | 135 | 0.041 |
| 59 | 0.63 | −90 | 140 | 0.076 |
| 60 | 0.89 | −95 | 120 | — |
| 61 | 0.55 | −90 | 190 | — |
| 62 | 0.64 | −90 | 135 | — |
| 63 | 0.78 | −120 | 180 | — |
| 64 | 0.53 | −95 | 150 | — |
| 65 | 0.53 | −95 | 155 | — |
| 66 | 0.52 | −90 | 155 | — |
| 67 | 0.61 | −100 | 145 | — |
| 68 | 0.61 | −100 | 150 | N.D |
| 69 | 0.6 | −95 | 155 | 0.052 |
| 70 | 0.6 | −90 | 145 | 0.066 |
| 71 | 0.75 | −90 | 160 | — |
| 72 | 0.57 | −110 | 200 | — |

TABLE 18-continued

| Comparative Example | Coefficient of kinetic friction | Initial bright portion potential (V) | Amount of variation in bright portion potential (ΔV) | Amount of (γ) in surface layer (% by mass) |
|---|---|---|---|---|
| 73 | 0.62 | −100 | 150 | — |
| 74 | 0.68 | −110 | 150 | — |
| 75 | 0.7 | −120 | 155 | N.D |
| 76 | 0.69 | −110 | 145 | 0.045 |
| 77 | 0.67 | −105 | 150 | 0.066 |
| 78 | 0.67 | −110 | 160 | — |

In comparing Examples with Comparative Examples, the surface layer of the electrophotographic photosensitive member containing the resin β having a siloxane structure at the end and further containing the compound γ exhibits the effect of reducing the initial friction coefficient and also suppressing the variation in bright portion potential due to the repeating use. On the other hand, the comparison of Comparative Example 18 with Comparative Example 19 suggests that the case where a dimethylsilicone oil is used as the resin β does not impart the effect by containing the compound γ, of suppressing the variation in potential due to the repeating use. In such a dimethylsilicone oil, the uniformity in film of the surface layer is significantly lowered, and thus there is a need for an improvement as an electrophotographic photosensitive member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-007483, filed Jan. 18, 2013, which is hereby incorporated by reference herein in its entirety.

What is claimed is:

1. An electrophotographic photosensitive member, comprising:

a support;

a photosensitive layer formed on the support;

wherein a surface layer of the electrophotographic photosensitive member comprises:

(α) at least one resin selected from the group consisting of a polycarbonate resin not having a siloxane structure at the end, and a polyester resin not having a siloxane structure at the end;

(β) at least one resin selected from the group consisting of a polycarbonate resin having a siloxane structure at the end, a polyester resin having a siloxane structure at the end, and an acrylic resin having a siloxane structure at the end; and (γ) at least one compound selected from the group consisting of propylene carbonate, γ-butyrolactone, δ-valerolactone and ϵ-caprolactone.

2. The electrophotographic photosensitive member according to claim 1, wherein a content of the compound of the above (γ) is not less than 0.001% by mass and not more than 1% by mass based on the total mass of the surface layer.

3. The electrophotographic photosensitive member according to claim 1, wherein the polycarbonate resin not having a siloxane structure at the end is a polycarbonate resin A having a structural unit represented by the following formula (A):

(A)

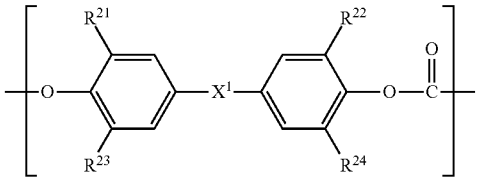

wherein $R^{21}$ to $R^{24}$ each independently represent a hydrogen atom, or a methyl group, and $X^1$ represents a single bond, a cyclohexylidene group, or a bivalent group having a structure represented by the following formula (C):

(C)

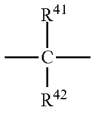

wherein $R^{41}$ and $R^{42}$ each independently represent a hydrogen atom, a methyl group, or a phenyl group.

4. The electrophotographic photosensitive member according to claim 1, wherein the polyester resin not having a siloxane structure at the end is a polyester resin B having a structural unit represented by the following formula (B):

(B)

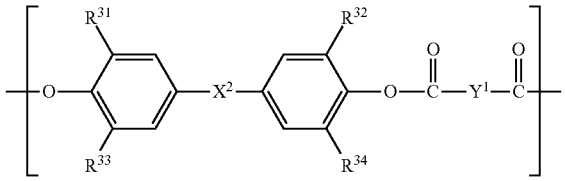

wherein $R^{31}$ to $R^{34}$ each independently represent a hydrogen atom, or a methyl group, $X^2$ represents a single bond, a cyclohexylidene group, or a bivalent group having a structure represented by the following formula (C), and $Y^1$ represents a m-phenylene group, a p-phenylene group, or a bivalent group having two p-phenylene groups bonded via an oxygen atom:

(C)

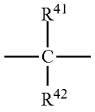

wherein $R^{41}$ and $R^{42}$ each independently represent a hydrogen atom, a methyl group, or a phenyl group.

5. The electrophotographic photosensitive member according to claim 1, wherein the polycarbonate resin having a siloxane structure at the end is a polycarbonate resin D having a structural unit represented by the following formula (A') and an end structure represented by the following formula (D):

(A')

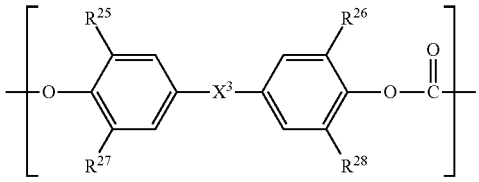

wherein $R^{25}$ to $R^{28}$ each independently represent a hydrogen atom, or a methyl group, and $X^3$ represents a single bond, a cyclohexylidene group, or a bivalent group having a structure represented by the following formula (C'):

(C')

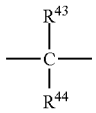

wherein $R^{43}$ to $R^{44}$ each independently represent a hydrogen atom, a methyl group, or a phenyl group; and (D)

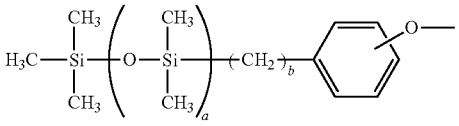

wherein

"a" and "b" each independently represent a number of repetitions of a structure enclosed in the parentheses, an average of "a" in the polycarbonate resin D is not less than 20 and not more than 100, and an average of "b" in the polycarbonate resin D is not less than 1 and not more than 10.

6. The electrophotographic photosensitive member according to claim 1, wherein the polyester resin having a siloxane structure at the end is a polyester resin E having a structural unit represented by the following formula (B') and an end structure represented by the following formula (D):

(B')

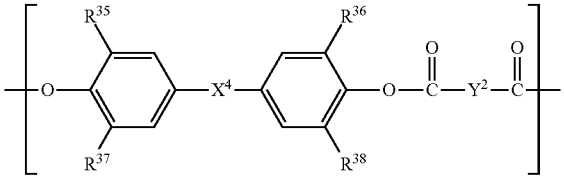

wherein $R^{35}$ to $R^{38}$ each independently represent a hydrogen atom, or a methyl group, $X^4$ represents a single bond, a cyclohexylidene group, or a bivalent group having a structure represented by the following formula (C'), and $Y^2$ represents a m-phenylene group, a p-phenylene group, or a bivalent group having two p-phenylene groups bonded via an oxygen atom:

(C')

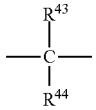

wherein $R^{43}$ and $R^{44}$ each independently represent a hydrogen atom, a methyl group, or a phenyl group; and (D)

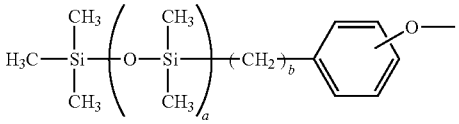

wherein

"a" and "b" each independently represent a number of repetitions of a structure enclosed in the parentheses, an average of "a" in the polyester resin E is not less than 20 and not more than 100, and an average of "b" in the polyester resin E is not less than 1 and not more than 10.

7. The electrophotographic photosensitive member according to claim 1, wherein the acrylic resin having a siloxane structure at the end is an acrylic resin F having a structural unit represented by the following formula (F-1) and a structural unit represented by the following formula (F-2), or an acrylic resin F having a structural unit represented by the following formula (F-1) and a structural unit represented by the following formula (F-3):

(F-1)

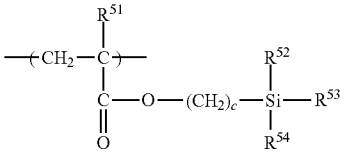

wherein $R^{51}$ represents a hydrogen atom, or a methyl group,

"c" represents a number of repetitions of a structure enclosed in the parentheses, an average of "c" in the acrylic resin F is not less than 0 and not more than 5, and $R^{52}$ to $R^{54}$ each independently represent a structure represented by the following formula (F-1-2), a methyl group, a methoxy group, or a phenyl group:

(F-1-2)

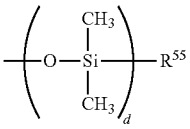

wherein

"d" represents a number of repetitions of a structure enclosed in the parentheses, an average of "d" in the acrylic resin F is not less than 10 and not more than 50, and $R^{55}$ represents a methyl group, or a hydroxyl group; and (F-2)

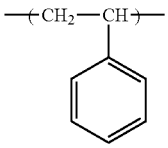

(F-3)

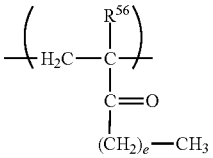

wherein $R^{56}$ represents a hydrogen atom, a methyl group, or a phenyl group, and "e" is 0 or 1.

8. The electrophotographic photosensitive member according to claim 1, wherein a content of the resin of the above (β) in the surface layer is not less than 1% by mass and not more than 50% by mass based on the total mass of the above resin (α).

9. A process cartridge detachably attachable to a main body of an electrophotographic apparatus, wherein the process cartridge integrally supports:

an electrophotographic photosensitive member according to claim 1, and at least one unit selected from the group consisting of a charging unit, a developing unit, a transferring unit, and a cleaning unit.

10. An electrophotographic apparatus comprising:

an electrophotographic photosensitive member according to claim 1;

a charging unit;

an exposure unit;

a developing unit; and a transferring unit.

* * * * *